US011778387B2

(12) United States Patent
Miyata

(10) Patent No.: US 11,778,387 B2
(45) Date of Patent: Oct. 3, 2023

(54) SOUND GENERATOR AND METHOD FOR MANUFACTURING THE SAME

(71) Applicant: DENSO ELECTRONICS CORPORATION, Anjo (JP)

(72) Inventor: Susumu Miyata, Anjo (JP)

(73) Assignee: DENSO ELECTRONICS CORPORATION, Anjo (JP)

( * ) Notice: Subject to any disclaimer, the term of this patent is extended or adjusted under 35 U.S.C. 154(b) by 228 days.

(21) Appl. No.: 17/404,778

(22) Filed: Aug. 17, 2021

(65) Prior Publication Data

US 2021/0377669 A1 Dec. 2, 2021

Related U.S. Application Data

(63) Continuation of application No. PCT/JP2020/004854, filed on Feb. 7, 2020.

(30) Foreign Application Priority Data

Mar. 13, 2019 (JP) ..... 2019-045656
Jan. 10, 2020 (JP) ..... 2020-003162

(51) Int. Cl.
*H04R 1/02* (2006.01)
*H04R 9/06* (2006.01)
(Continued)

(52) U.S. Cl.
CPC ..... *H04R 9/06* (2013.01); *H04R 1/021* (2013.01); *H04R 1/023* (2013.01); *H04R 1/026* (2013.01);
(Continued)

(58) Field of Classification Search
CPC ..... H04R 1/021; H04R 1/023; H04R 1/026; H04R 1/06; H04R 1/2873; H04R 29/001;
(Continued)

(56) References Cited

U.S. PATENT DOCUMENTS 7,869,617 B2 * 1/2011 Jang ..... H04R 1/2842 381/396
7,953,461 B2 * 5/2011 Fukazawa ..... H04R 1/225 455/575.1
(Continued)

FOREIGN PATENT DOCUMENTS

JP 2018121249 A 8/2018

*Primary Examiner* — Huyen D Le
(74) *Attorney, Agent, or Firm* — Harness, Dickey & Pierce, P.L.C.

(57) ABSTRACT

A sound generator includes a sound generating body, a base, a protection wall, and an erected wall. The sound generating body includes a diaphragm and a driving portion. The base includes a base tubular portion and a partition wall defining a sound hole. The diaphragm and the partition wall divide an inner space of the base tubular portion into a first space and a second space. The protection wall is disposed away from the partition wall and the erected wall connects between the protection wall and the base tubular portion. The protection wall, the erected wall, and the partition wall defines a sound emission space in communication with the first space through the sound hole. The protection wall and the erected wall define an emission hole through which the sound exits.

18 Claims, 17 Drawing Sheets

(51) Int. Cl.
*H04R 7/12* (2006.01)
*H04R 9/04* (2006.01)
*H04R 31/00* (2006.01)

(52) U.S. Cl.
CPC ..... *H04R 7/127* (2013.01); *H04R 9/046* (2013.01); *H04R 31/003* (2013.01); *H04R 2499/13* (2013.01)

(58) Field of Classification Search
CPC ..... H04R 31/003; H04R 7/127; H04R 7/20; H04R 9/046; H04R 9/06; H04R 2499/11; H04R 2499/13; H04M 1/035
See application file for complete search history.

(56) References Cited

U.S. PATENT DOCUMENTS

| | | | | |
|---|---|---|---|---|
| 10,462,555 | B2 * | 10/2019 | Ito ..... | H04R 1/2842 |
| 2013/0223655 | A1 * | 8/2013 | Lee ..... | H04R 1/34 381/189 |
| 2019/0313192 | A1 | 10/2019 | Miyata et al. | |

* cited by examiner

SOUND GENERATOR AND METHOD FOR MANUFACTURING THE SAME

CROSS REFERENCE TO RELATED APPLICATION

The present application is a continuation application of International Patent Application No. PCT/JP2020/004854 filed on Feb. 7, 2020, which designated the U.S. and claims the benefit of priority from Japanese Patent Application No. 2019-045656 filed on Mar. 13, 2019 and Japanese Patent Application No. 2020-003162 filed on Jan. 10, 2020. The entire disclosures of all of the above applications are incorporated herein by reference.

TECHNICAL FIELD

The present disclosure relates to a sound generator and a method for manufacturing the same.

BACKGROUND

A sound generator used for an acoustic vehicle alerting system is proposed. In this sound generator, a base includes a cylindrical base portion and both ends of the base are covered by a cover and a case to configure a housing. The housing houses a sound generating body and the cover defines a sound hole in a center of the cover.

SUMMARY

A sound generator is configured to generate a sound by vibrating a diaphragm. The sound generator includes a sound generating body, a base, a protection wall, and an erected wall. The sound generating body includes the diaphragm and a driving portion configured to vibrate the diaphragm when energized to generate the sound. The base includes a base tubular portion configured to house the sound generating body and a partition wall disposed in one end portion of the base tubular portion in an axial direction of the base tubular portion. The partition wall has a sound emission portion where the sound generating body is disposed. The sound emission portion of the partition wall defines a sound hole through which the sound generated by the sound generating body emits. The diaphragm and the partition wall divide an inner space of the base tubular portion into a first space and a second space. The protection wall is disposed away from the partition wall in a vibrating direction of the diaphragm with a gap to cover the sound emission portion of the partition wall. The erected wall connects between the protection wall and the base tubular portion and the protection wall, the erected wall, and the partition wall defines a sound emission space. The sound emission space is in communication with the first space through the sound hole. The protection wall and the erected wall define an emission hole opening in at least one direction. The sound emits into the sound emission space through the sound hole from the first space and exits through the emission hole.

A method of manufacturing a sound generator configured to generate a sound by vibrating a diaphragm includes a preparing step and a testing step. In the preparing step, when Ya is defined as a distance between one surface of a partition wall and a protection wall and Yb is defined as a distance between the one surface of the partition wall and a boundary between an inner circumferential portion and an outer circumferential portion of the diaphragm, Ya>Yb is satisfied. In the testing step, a jig is inserted into a sound hole through an emission hole and increasing a pressure in a first space to be higher than a pressure in a second space and to inflate the diaphragm toward the first space while the jig is set inside the sound hole.

DESCRIPTION OF EMBODIMENTS

Figure 1:
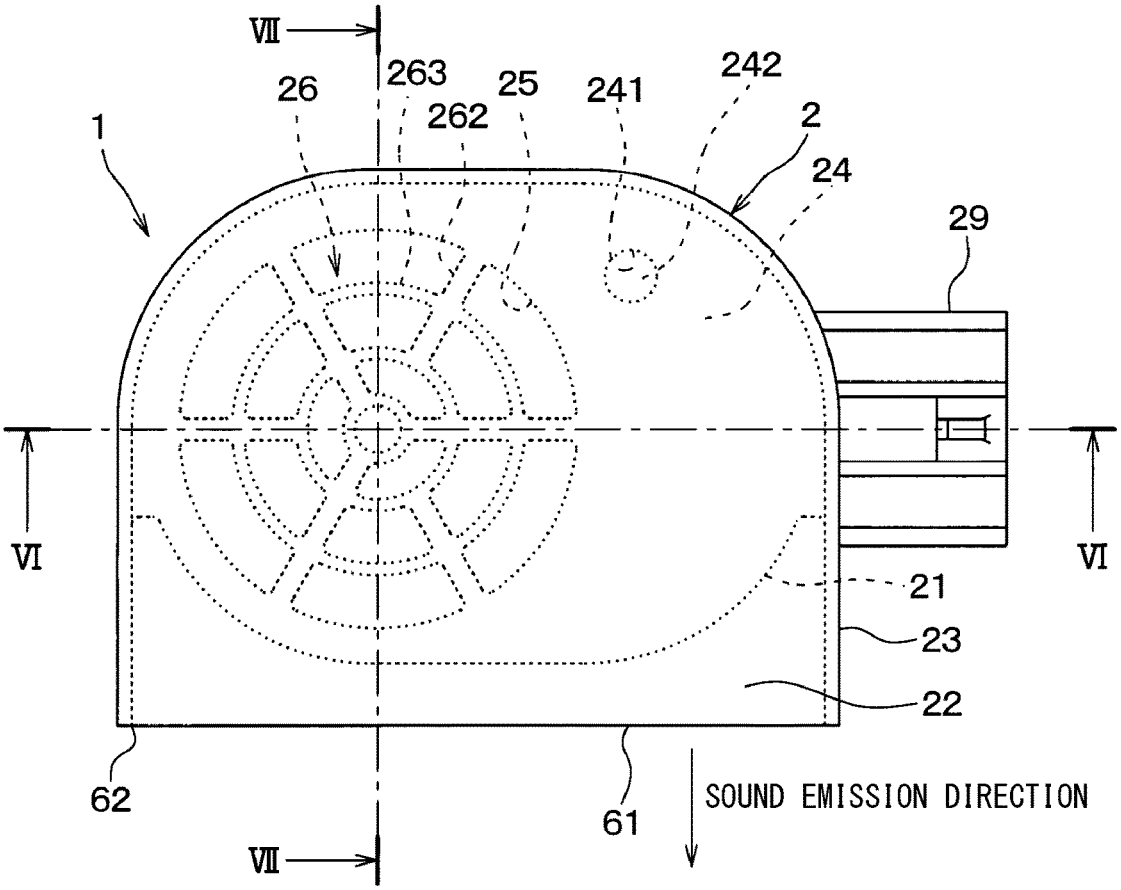
FIG. 1 is a front view of a sound generator of a first embodiment.

To begin with, examples of relevant techniques will be described.

A sound generator used for an acoustic vehicle alerting system is proposed. In this sound generator, a base includes a cylindrical base portion and both ends of the base are covered by a cover and a case to configure a housing. The housing houses a sound generating body and the cover defines a sound hole in a center of the cover. Sound generated by the sound generating body is emitted through the sound hole. In addition, the sound generator defines multiple sound holes in a front surface and side surfaces of the sound generator so that the sound can be emitted regardless of a mounting position of the sound generator in the vehicle. Specifically, the multiple sound holes are annularly disposed in a center portion of the cover facing the sound generating body and side surface portions of the base so that the sound can be emitted toward a front side of the sound generator and an all circumference of the sound generator.

However, since the sound generator annularly defines the multiple sound holes in the side surface portions of the base and the center portion of the cover so that the sound generator can be positioned in any place in the vehicle, the sound is naturally emitted in unnecessary directions. Therefore, the sound transmits and propagates through a vehicle compartment, so that noise may be generated in the vehicle compartment.

Further, the sound generator is configured to emit the sound through a front surface of the sound generator. Thus, when the sound generator is disposed in the vehicle, it is necessary to secure a space through which the sound propagates on a side of the cover of the sound generator. Thus, vehicle components cannot be disposed close to the front surface of the sound generator. Therefore, there is an issue that the sound generator cannot be arranged in a narrow space in the vehicle.

In view of the above points, it is an object of the present disclosure to provide a sound generator that can reduce a noise in a vehicle compartment and allows to position vehicle components close to a front of the sound generator and a method for manufacturing the sound generator.

In order to achieve the above object, according to an aspect of the present disclosure, a sound generator is configured to generate a sound by vibrating a diaphragm. The sound generator includes a sound generating body, a base, a protection wall, and an erected wall. The sound generating body includes the diaphragm and a driving portion configured to vibrate the diaphragm when energized to generate the sound. The base includes a base tubular portion configured to house the sound generating body and a partition wall disposed in one end portion of the base tubular portion in an axial direction of the base tubular portion. The partition wall has a sound emission portion where the sound generating body is disposed. The sound emission portion of the partition wall defines a sound hole through which the sound generated by the sound generating body emits. The diaphragm and the partition wall divide an inner space of the base tubular portion into a first space (4) and a second space (5). The protection wall is disposed away from the partition wall in a vibrating direction of the diaphragm with a gap to cover the sound emission portion of the partition wall. The erected wall connects between the protection wall and the base tubular portion and the protection wall, the erected wall, and the partition wall defines a sound emission space. The sound emission space is in communication with the first space through the sound hole. The protection wall and the erected wall define an emission hole opening in at least one direction. The sound emits into the sound emission space through the sound hole from the first space and exits through the emission hole.

As a result, the sound emitted by the sound generating body is output in one direction through the sound emission space and the emission hole. Therefore, it is possible to restrict the sound from being emitted in an unnecessary direction and restrict the unnecessary sound from propagating through the vehicle compartment. In addition, if a protection wall is disposed to cover the sound hole at a position in front of the sound generator, that is, in the vibration direction of the diaphragm, the vehicle components can be mounted at a position in the vehicle adjacent to the protection wall of the sound generator.

According to another aspect of the present disclosure, a method of manufacturing a sound generator configured to generate a sound by vibrating a diaphragm includes a preparing step and a testing step. In the preparing step, when Ya is defined as a distance between one surface of a partition wall and a protection wall and Yb is defined as a distance between the one surface of the partition wall and a boundary between an inner circumferential portion and an outer circumferential portion of the diaphragm, Ya>Yb is satisfied. In the testing step, a jig is inserted into a sound hole through an emission hole and increasing a pressure in a first space to be higher than a pressure in a second space and to inflate the diaphragm toward the first space while the jig is set inside the sound hole.

As described above, by satisfying at least Ya>Yb, it is possible to contribute to stabilizing an airtightness inspection and reducing an inspection time by using the jig.

Hereinafter, embodiments of the present disclosure will be described with reference to the drawings. In each embodiment described below, same or equivalent parts are designated with the same reference numerals.

First Embodiment

A first embodiment will be described. A sound generator of the present embodiment is disposed, for example, outside of a vehicle compartment and used for generating an alarm sound. The sound generator includes a housing defining therein two spaces and a sound generating body disposed in the housing. The sound generator is configured to generate a sound with the sound generating body.

Specifically, as shown in FIGS. 1 to 6, the housing 1 of the sound generator is configured with two parts of a base 2 and a case 3 that are made of resin.

The base 2 includes a base tubular portion 21 that has a substantially elongated cylindrical shape and has one end opening and the other end opening in an axial direction of the base tubular portion 21. The base 2 further includes a protection wall 22 formed to cover the one end opening of the base tubular portion 21. The case 3 has an oval plate shape and is fitted to the base 2 to cover the other end opening and gas-tightly joined to the base 2 with an adhesive. A sound generating body 7, which will be described later, is to be assembled to the other end opening of the base tubular portion 21. Since the oval shaped case 3 is gas-tightly adhered to the other end opening, a waterproof and an airtightness of a portion of the base tubular portion to which the sound generating body 7 is assembled can be ensured.

Figure 6:
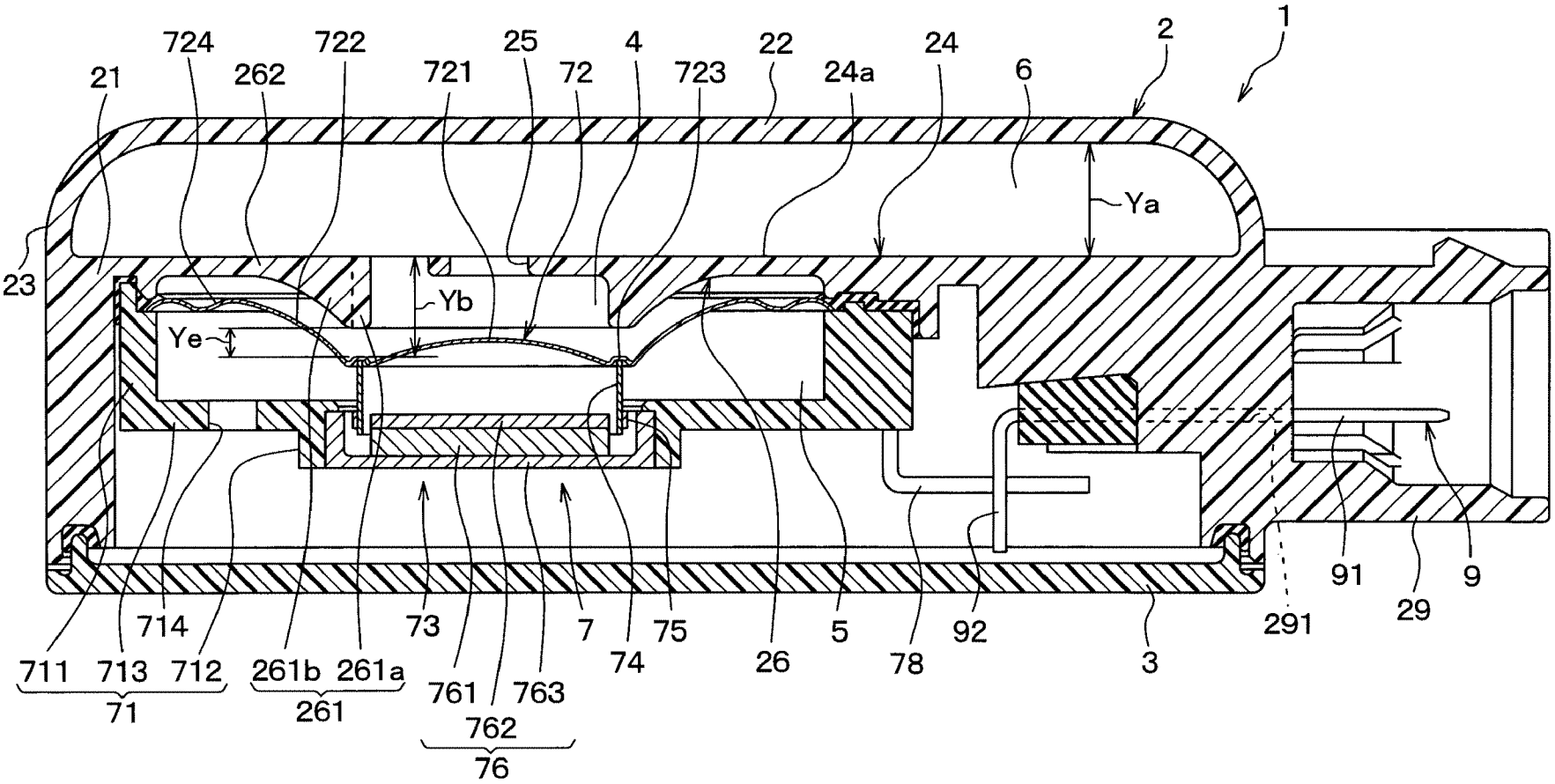
FIG. 6 is a cross-sectional view taken along a line VI-VI in FIG. 1.

As shown in FIG. 6, the protection wall 22 is connected to the base tubular portion 21 with an erected wall 23 that extends from an outer edge of the base tubular portion 21 except for a portion of the outer edge in one direction. Thus, the protection wall 22 is disposed away from one surface 24*a* of a partition wall 24 configuring one end surface of the base tubular portion 21 with a predetermined dimension Ya. The protection wall 22 covers the one end opening of the base tubular portion 21. More specifically, the protection wall 22 covers the base tubular portion 21 such that the sound generating body 7 disposed inside of the one end opening cannot be directly viewed from a front side of the sound generator (i.e., in a normal direction in FIG. 1). Thus, foreign matters such as water, snow, chipping, and the like are prevented from entering into the sound generating body 7.

Figure 7:
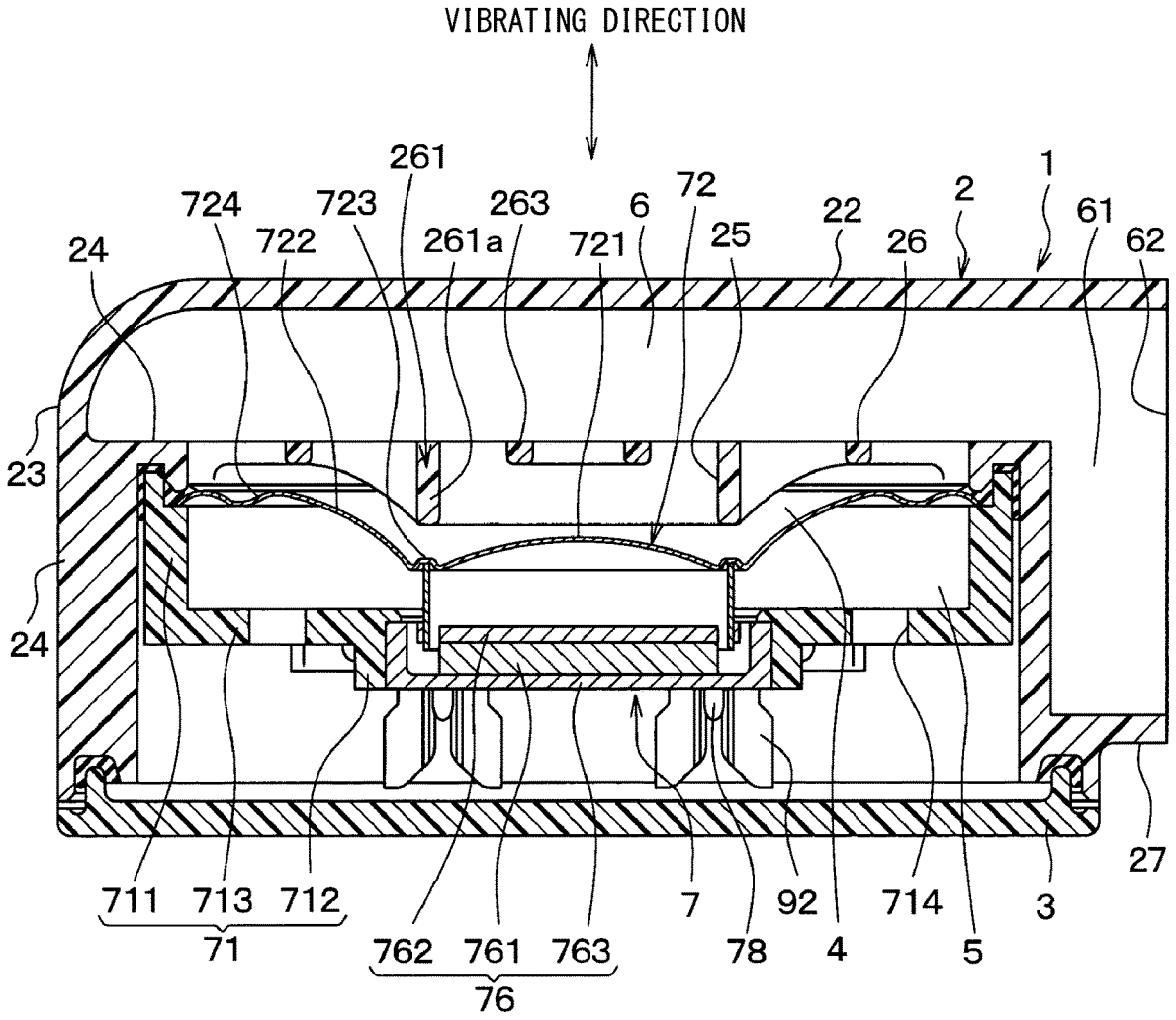
FIG. 7 is a cross-sectional view taken along a line VII-VII in FIG. 1.

Then, as shown in FIGS. 6 and 7, an inner space of the base tubular portion 21 is divided into two spaces by the partition wall 24 disposed inside the base tubular portion 21. Specifically, the partition wall 24 defines sound holes 25 through which a sound generated by the sound generating body 7 emits and includes a beam portion 26 around the sound holes 25. The sound generating body 7 is disposed to cover the sound holes 25 and the beam portion 26, so that the inner space of the base tubular portion 21 is divided into the two spaces. The sound generating body 7 includes a diaphragm 72. A first space 4 is defined by the base tubular portion 21, the partition wall 24, and the diaphragm 72 of the sound generating body 7. A second space 5 is defined by the base tubular portion 21, the partition wall 24, the case 3, and the diaphragm 72.

Further, the first space 4 is in communication with a sound emission space 6 that is defined by the protection wall 22 and the erected wall 23, which will be described later. Sound emitted in the first space 4 propagates through the sound emission space 6 and output through an emission hole 61 that is defined in a lower portion in FIG. 1. Hereinafter, an output direction of the sound through the emission hole 61 is defined as a sound emission direction.

Figure 8:
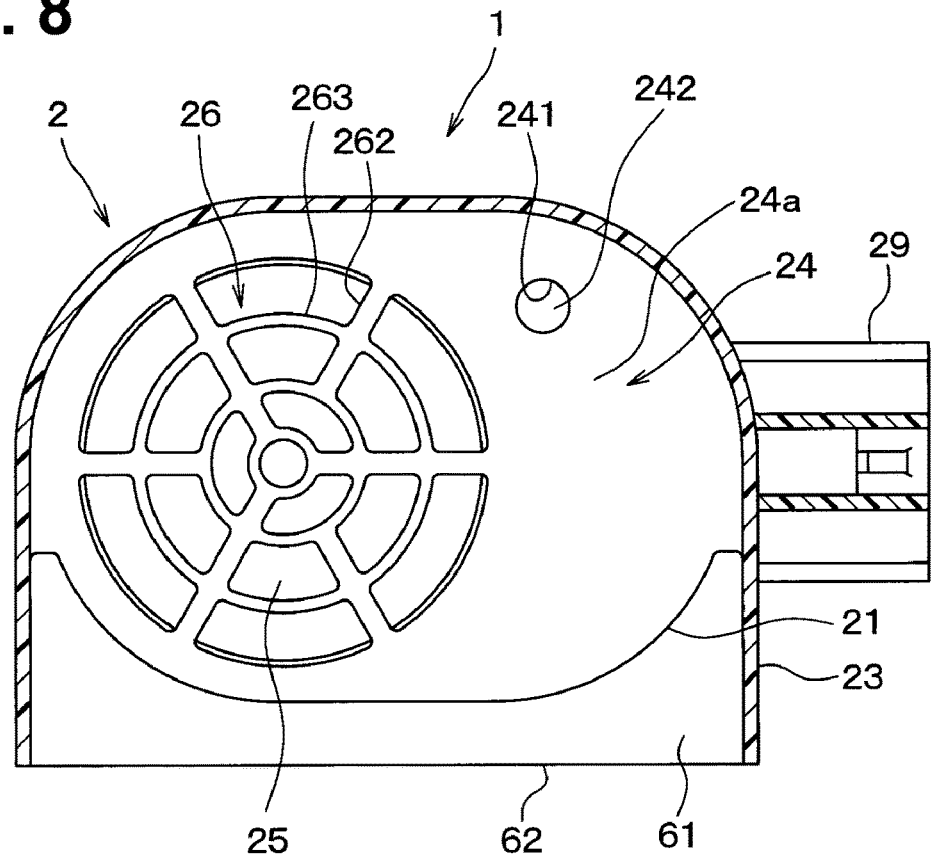
FIG. 8 is a cross-sectional view taken along a line VIII-VIII in FIG. 2.

As shown in FIGS. 1 and 8, the partition wall 24 substantially has an oval shape and the base tubular portion 21 protrudes from the outer edge of the partition wall 24 in a direction away from the protection wall 22. The erected wall 23 is formed along a half part of an outer circumference of the base tubular portion 21 and the partition wall 24, which is cut along a major axis of the oval shape of the base tubular portion 21 and the partition wall 24. Both ends of the erected wall 23 in a longitudinal direction of the oval shape further extends in a tangent line direction, in other words, in the emission direction.

Figure 2:
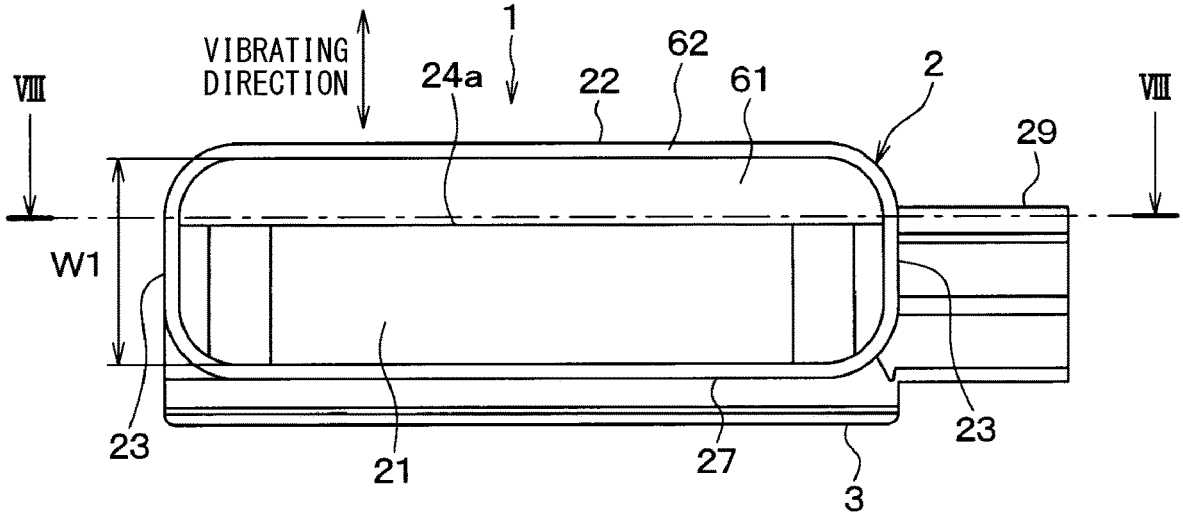
FIG. 2 is a bottom view of the sound generator shown in FIG. 1.
Figure 3:
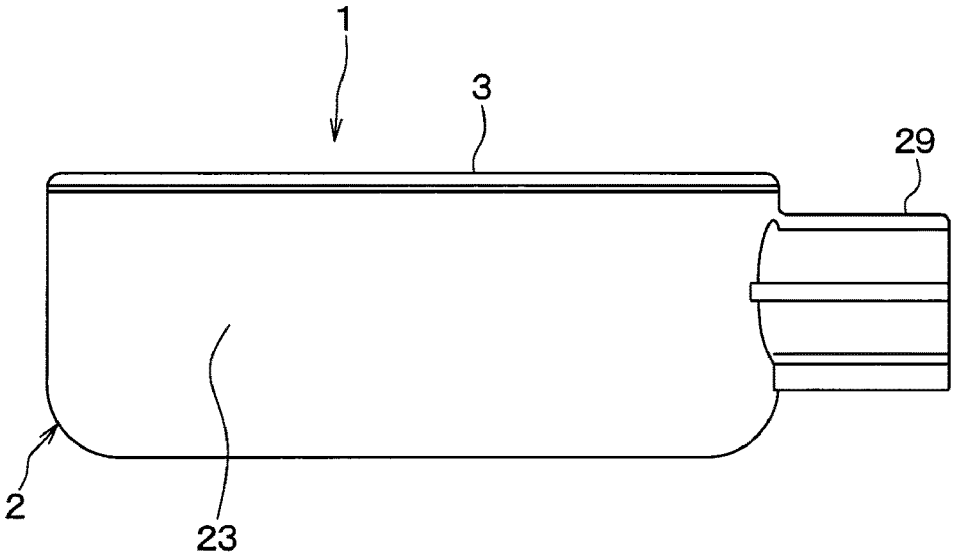
FIG. 3 is a top view of the sound generator shown in FIG. 1.
Figure 4:
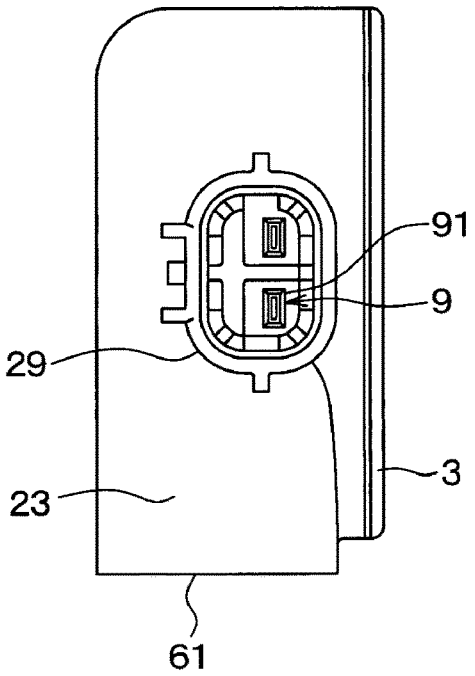
FIG. 4 is a right side view of the sound generator shown in FIG. 1.

In the case of the present embodiment, the protection wall 22 and the erected wall 23 protrude from the base tubular portion 21 in the emission direction. Further, as shown in FIGS. 2 and 7, a facing wall 27 is formed to face a protruding portion of the protection wall 22. The base tubular portion 21 is disposed between the protection wall 22 and the facing wall 27. The protection wall 22, the erected wall 23, and the facing wall 27 define an opening in one direction intersecting a vibrating direction. As a result, as shown in FIG. 2, the protection wall 22, the erected wall 23, and the facing wall 27 define an emission hole 61 surrounded by the protection wall 22, the erected wall 23, and the facing wall 27. Further, the sound emission space 6 surrounded by the protection wall 22, the erected wall 23, and the partition wall 24 is defined in the housing 1 on a far side from the emission hole 61. As shown in FIG. 2, the emission hole 61 has a predetermined width W1 and has a flat shape having a longitudinal direction in a direction perpendicular to the width direction. Thus, it is easy to apply the sound generator in the vehicle. That is, a portion of the erected wall 23 defining the emission hole 61 has a length shorter than a length of a portion the protection wall 22 defining the emission hole 61. Thus, the emission hole 61 has an elongated shape having a portion defined by the erected wall 23 in a widthwise direction and a portion defined by the erected wall 23 in a longitudinal direction. Therefore, the vibrating direction of the diaphragm is set to the widthwise direction, so that a thickness of the product can be reduced while an opening area required for an acoustic pressure can be secured even if the sound generator has the elongated shape.

Figure 5:
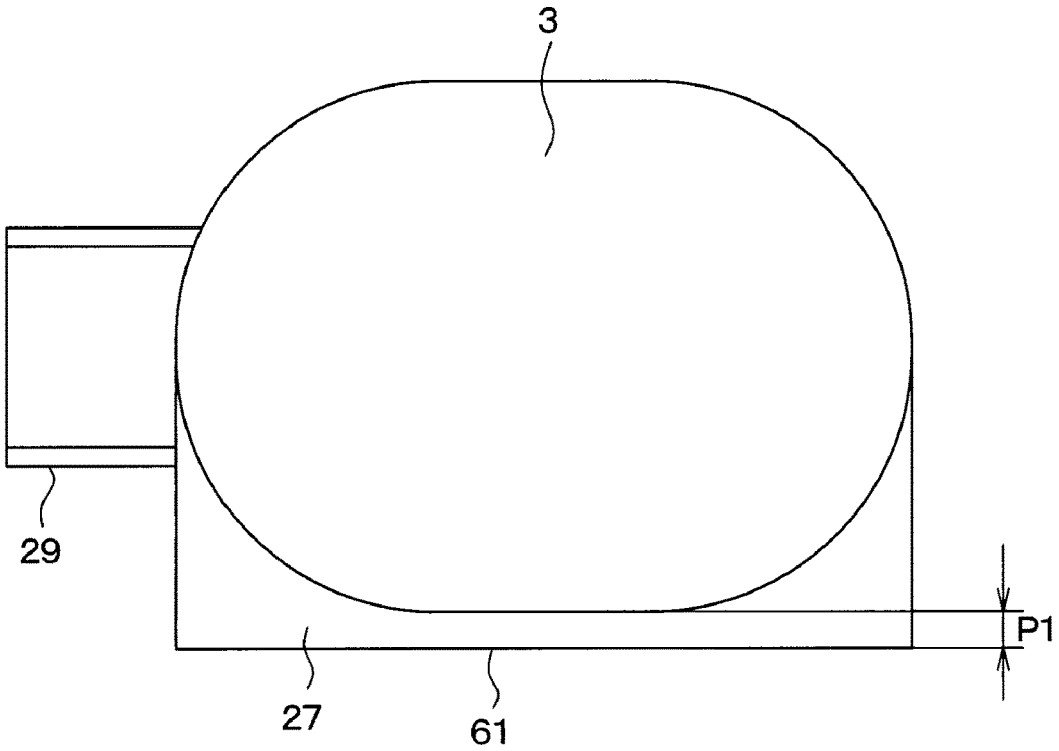
FIG. 5 is a rear view of the sound generator shown in FIG. 1.

As shown in FIG. 5, the protection wall 22, the erected wall 23, and the facing wall 27 protrude from the base tubular portion 21 by a predetermined length P1. However, they may not protrude from the base tubular portion 21. In case that they protrude from the base tubular portion 21, by adjusting a protruding length of them, a resonance effect of the sound can be obtained or a resonance frequency can be adjusted to change an acoustic quality and an acoustic pressure. Further, the facing wall 27 is provided since the protection wall 22 and the erected wall 23 protrude from the base tubular portion 21. However, when the protection wall 22 and the erected wall 23 do not protrude, the facing wall 27 is not necessarily provided.

As shown in FIGS. 1, 7, and 8, a distal end of the protection wall 22, a distal end of the erected wall 23, and a distal end of the facing wall 27 are aligned with each other and extend on a common imaginary plane. Hereinafter, a surface defined by the distal end surfaces of the protection wall 22, the erected wall 23, and the facing wall 27 on the imaginary plane is referred to as an emission surface 62. In the present embodiment, as shown in FIG. 7, the emission surface 62 is parallel to the vibrating direction of the diaphragm 72. In addition, as shown in FIG. 8, the emission surface 62 is parallel to the longitudinal direction of the base tubular portion 21. Sound is emitted outward through the emission hole 61 in a normal direction of the emission surface 62 as a center and transmitted to an outside of the sound generator. Therefore, the emission direction of the sound is specified based on a position of the emission hole 61 and the normal direction of the emission surface 62.

Further, a portion of the partition wall around a center of the partition wall 24 is defined as a sound emission portion where the sound generating body 7 configured to generate a sound based on electric signals is disposed. As shown in FIGS. 1 and 8, the sound emission portion of the partition wall 24 defines through holes serving as multiple sound holes 25. Then, as shown in FIGS. 6 and 7, the sound generating body 7 is disposed in the second space 5 to close the sound holes 25. More specifically, the sound holes 25 are covered by the diaphragm 72 of the sound generating body 7. Therefore, the second space 5 is separated from the first space 4 by the diaphragm 72.

An airtightness between the first space 4 and the second space 5 is ensured by the diaphragm 72 and the like. Therefore, in order to suppress a fluctuation of pressure applied to the diaphragm 72 which is caused by the temperature change, as shown in FIGS. 1 and 8, the partition wall 24 defines a ventilation hole 241 in communication between the first space 4 and the second space 5 in a position outside of the sound emission portion. A ventilation film 242 made of a material that allows air to pass therethrough and prevents water from passing therethrough is attached to the ventilation hole 241 to adjust the pressure fluctuation applied to the diaphragm 72.

As shown in FIGS. 1 and 6 to 8, a portion of the sound emission portion other than the sound holes 25 serves as the beam portion 26. The beam portion 26 includes a stopper 261 protruding from a surface of the beam portion 26 facing the diaphragm 72. As shown in FIGS. 1 and 8, in the present embodiment, the beam portion 26 includes radial beam portions 262 radially extending from a center of the sound emission portion and circular beam portions 263 coaxially disposed with each other. Further, in the present embodiment, the number of the circular beam portions 263 is three.

In this embodiment, the number of the radial beam portions 262 is six and the six radial beam portions 262 are arranged at equal intervals. Three of the six radial beam portions 262 are arranged at intervals of an angle 120° and extend between the inner most circular beam portion 263 and the outer circumference of the sound emission portion. The other three of the six radial beam portions 262 extend from the second innermost circular beam portion 263 and the outer circumference of the sound emission portion.

Since the beam portion 26 covers a portion of the sound emission portion other than the sound holes 25, the beam portion 26 restricts water and chipping from reaching the sound generating body 7 during a driving of the vehicle and prevents the sound generating body 7 from being broken due to a contact with water and chipping. In the present embodiment, the one surface 24*a* of the partition wall 24 that includes the beam portion 26 and that faces the protection wall 22 is flat, but may have irregularities. However, in case that an entire of the base 2 is formed by resin molding at one time, a slide mold is disposed between the one surface 24*a* and the protection wall 22. Thus, the one surface 24*a* is formed such that the slide mode can be removed.

Further, the stopper 261 is configured to restrict the diaphragm 72 from moving in the vibrating direction by contacting with the diaphragm 72 when the diaphragm 72 is displaced during an airtightness inspection. As a result, damage due to excessive deformation of the diaphragm 72 can be reduced. As shown in FIGS. 6 and 7, the stopper 261 is arranged to face the diaphragm 72 and has a shape corresponding to the diaphragm 72.

Specifically, the stopper 261 protrudes toward the diaphragm 72 from the radial beam portions 262 and the second innermost circular beam portion 263 of the three circular beam portions 263. A portion of the stopper 261 protruding from the circular beam portion 263 configures a cylindrical portion 261*a* protruding into a cylindrical shape along the circular beam portion 263. Further, portions of the stopper 261 protruding from the radial beam portions 262 configure tilted portions 261*b* that are tilted radially outward about the cylindrical portion 261*a* as a center. When a height of the stopper 261 is defined as a distance of the stopper 261 from the one surface 24*a*, the cylindrical portion 261*a* has the same height in an entire circumferential direction and the cylindrical portion 261*a* is highest in the stopper 261. Further, a portion of the tilted portions 261*b* connected to the cylindrical portion 261*a* has a height same as that of the cylindrical portion 261*a*. The height of the tilted portions 261*b* is gradually decreased in a direction away from the cylindrical portion 261*a*.

The tilted portions 261*b* are formed in all of the radial beam portions 262. However, the tilted portions 261*b* may be formed in a portion of the radial beam portions 262. For example, the tilted portions 261*b* may be formed only in the radial beam portions 262 extending between the second innermost circular beam portion 263 and the outer circumference of the sound emission portion, or only in the radial beam portions 262 extending between the innermost cylindrical beam portion 263 and the outer circumference of the sound emission portion.

As shown in FIGS. 1 to 4 and 6 to 9, a connector 29 which substantially has a square tubular shape is formed at outside of the base tubular portion 21 for electrically connecting the sound generating body 7 to an external harness (not shown). The connector 29 extends in a direction intersecting the vibrating direction of the diaphragm 72 and extends along a direction parallel to the partition wall 24 at a position outside of the erected wall 23. As a result, a thickness of the product can be reduced. As shown in FIG. 6, a portion of the base tubular portion 21 forming the connector 29 defines a through hole 291 passing through the base tubular portion 21 between an inside of the connector 29 and the second space 5. A terminal 9 is press-fit into the through hole 291.

The terminal 9 is disposed in the base tubular portion 21 and fixed to the base tubular portion 21 with an adhesive. The through hole 291 for disposing the terminal 9 is closed by the adhesive and the terminal 9. The terminal 9 is connected to a lead pin 78, which will be described later, in the second space 5.

As shown in FIG. 6, the terminal 9 includes a flat plate rod-shaped terminal portion 91 having a longitudinal direction and a connecting portion 92 connected to the lead pin 78. The terminal portion 91 is a portion inserted into the through hole 291. The terminal portion 91 has one end positioned inside the second space 5 and the other end positioned inside the connector 29. The connecting portion 92 is connected to the one end of the terminal portion 91 positioned in the second space 5 and curved in a direction intersecting the longitudinal direction of the terminal portion 91 (in this embodiment, in a direction perpendicular to the longitudinal direction).

Figure 9:
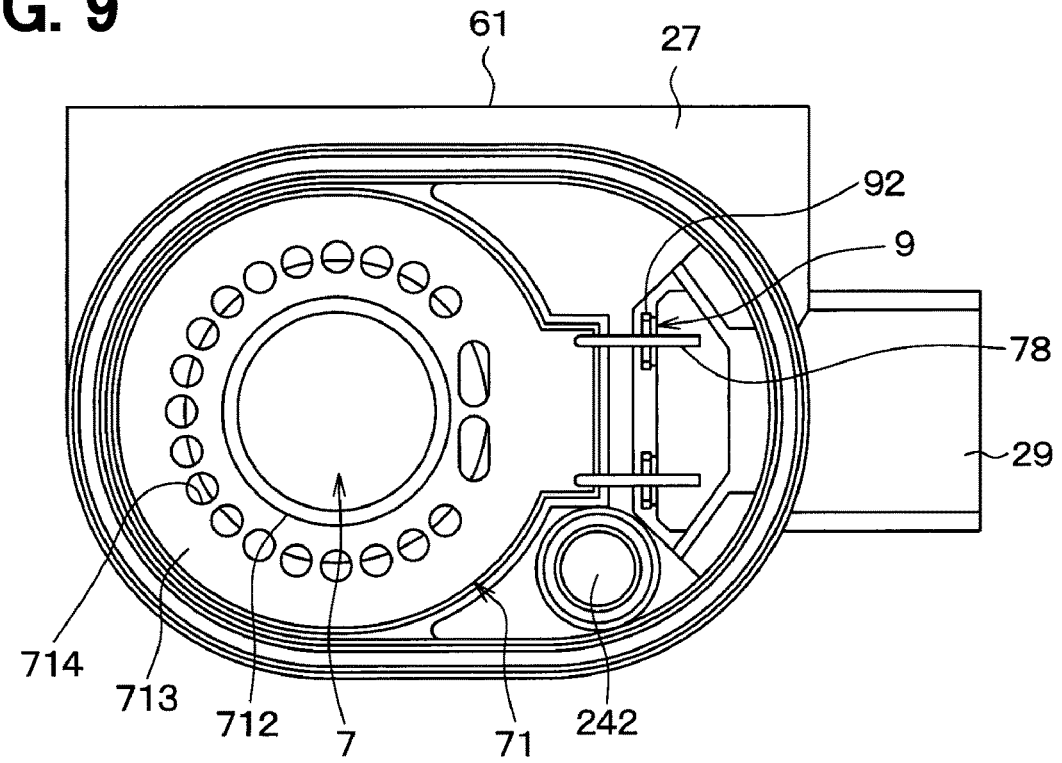
FIG. 9 is a rear view of the sound generator without a case.

As shown in FIGS. 6, 7, and 9, the sound generating body 7 includes a frame 71, the diaphragm 72, and a driving portion 73 configured to vibrate the diaphragm 72.

The frame 71 has a substantially stepped cylindrical shape and is made of resin. The frame 71 has openings at both ends in the axial direction. The frame 71 includes a cylindrical portion 711 defining one of the openings, a cylindrical portion 712 defining the other of the openings, and a stepped portion 713 having a circular disk shape and connecting between the cylindrical portion 711 and the cylindrical portion 712. The opening defined by the cylindrical portion 711 is larger than the opening defined by the cylindrical portion 712. The opening defined by the cylindrical portion 711 is closed by the diaphragm 72. The frame 71 is gas-tightly joined to the partition wall 24 with an adhesive and fixed to the base 2 at an end portion of the frame 71 closer to the opening closed by the diaphragm 72.

Further, as shown in FIGS. 6 and 9, the stepped portion 713 defines a through hole 714 that fluidly connects between an inside and an outside of the frame 71. The second space 5 is a space that the inside of the frame is in communication with the outside of the frame 71 through the through hole 714. The second space 5 is separated from the first space 4 by the partition wall 24 and the diaphragm 72.

The diaphragm 72 is configured to vibrate to generate a sound. As shown in FIG. 6, the diaphragm 72 has an inner circumferential portion 721 having a convex surface protruding toward the first space 4. Further, the diaphragm 72 has an outer circumferential portion 722 tilted toward the first space 4. Specifically, the outer circumferential portion 722 has a hollow truncated cone shape that extends from an outer edge of the inner circumferential portion 721 toward the first space 4.

Figure 10:
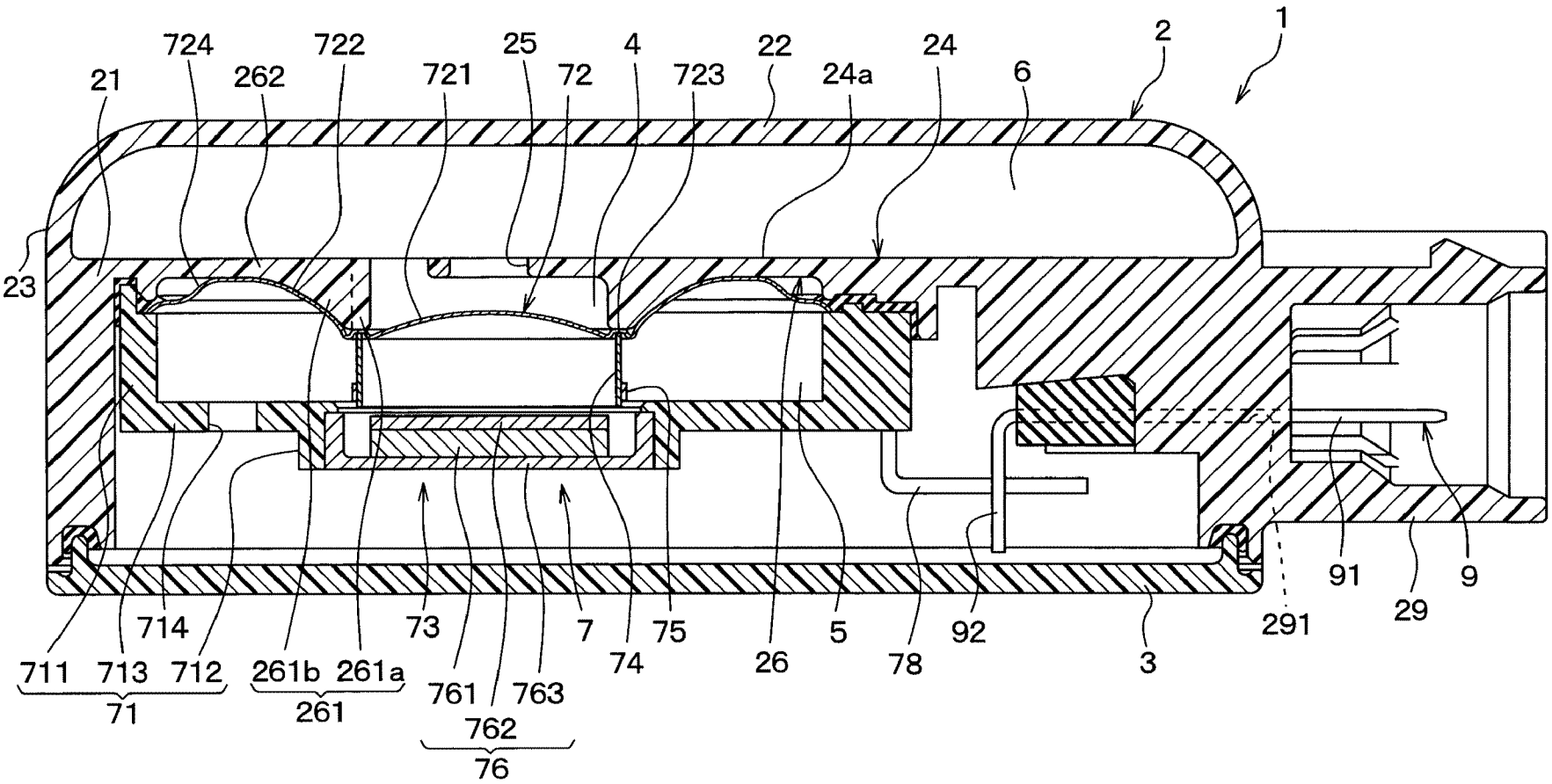
FIG. 10 is a cross-sectional view of the sound generator during an airtightness inspection.
Figure 11:
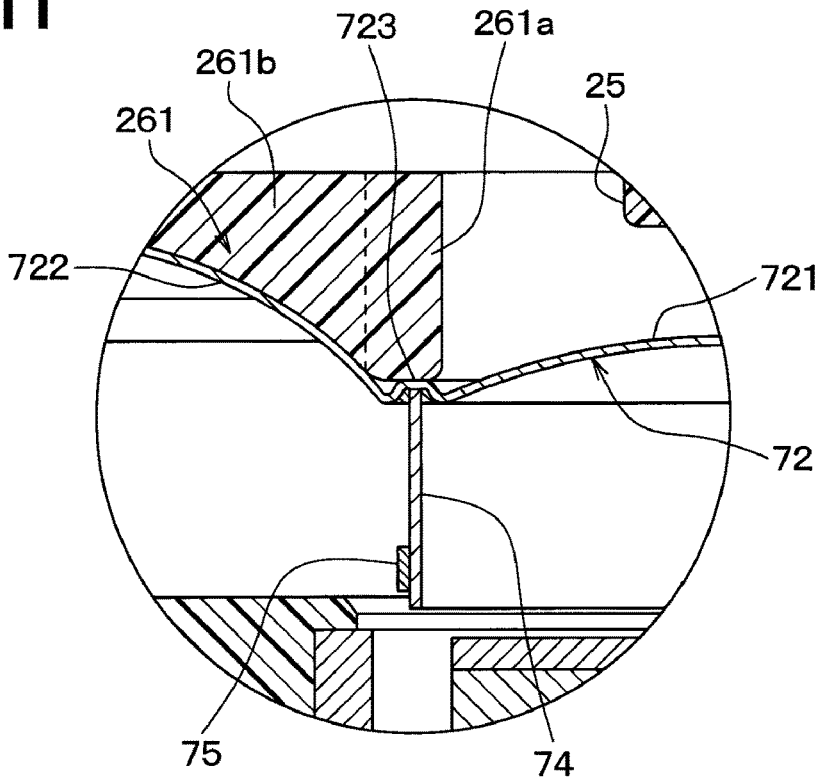
FIG. 11 is an enlarged view showing a state where a stopper and a diaphragm are in contact with each other during the airtightness inspection.

The inner circumferential portion 721 and the outer circumferential portion 722 define a circular boundary therebetween. The boundary has the same diameter as that of the cylindrical portion 261*a* of the stopper 261 and faces the cylindrical portion 261*a*. Further, a tilt of the outer circumferential portion 722 is the same as a tilt of the tilted portions 261*b* of the stopper 261 and the outer circumferential portion 722 is disposed to face the tilted portions 261*b*. Further, as shown in FIG. 6, the diaphragm 72 includes a circular end portion 723 at the circular boundary between the inner circumferential portion 721 and the outer circumferential portion 722. The circular end portion 723 faces the cylindrical portion 261*a* and is configured to move the most in the vibrating direction of the diaphragm 72 when the diaphragm 72 is moved. When the diaphragm 72 is moved during the airtightness inspection, as shown in FIGS. 10 and 11, the circular end portion 723 comes into contact with the cylindrical portion 261*a* and the outer circumferential portion 722 comes into contact with the tilted portions 261*b*. The sound generating body 7 includes a bobbin 74. One end of the bobbin 74 is fixed to a portion of the circular end portion 723 facing the driving portion 73 with an adhesive, so that the bobbin 74 are integrally formed with the diaphragm 72. Therefore, the circular end portion 723 is a strong portion in the diaphragm 72 and the cylindrical portion 261*a* can come into contact with the hard and high-strength portion.

As will be described later, the sound generating body 7 configured to vibrate the diaphragm 72 to generate a sound. In order to generate a sound having a sufficiently high acoustic pressure, it is necessary to increase a distance between the diaphragm 72 and the stopper 261 to some extent. Therefore, the distance between the surface of the diaphragm 72 to come into contact with the stopper 261 and the surface 261 of the stopper to come into contact with the diaphragm 72 is set to a value greater than a displacement amount of the diaphragm 72 during a sounding operation such that the diaphragm 72 does not come into contact with the stopper 261. Then, during the airtightness inspection, the diaphragm 72 is displaced more than during the sounding operation in order to come into contact with the stopper 261.

For example, the distance between the surface of the diaphragm 72 to come into contact with the stopper 261 and the surface of the stopper 261 to come into contact with the diaphragm 72 is about 1 mm to 3 mm.

Further, an end portion of the outer circumferential portion 722 opposite to the inner circumferential portion 721 has a ring shape when viewed in an axial direction of the outer circumferential portion 722. A spring portion 724 having a S-shaped cross-section along a radial direction is connected to the end portion of the outer circumferential portion 722 opposite to the inner circumferential portion 721. An end portion of the spring portion 724 of the diaphragm 72 is adhered to the frame 71. In the present embodiment, the inner circumferential portion 722, the outer circumferential portion 722, the circular end portion 723, and the spring portion 724 are formed with a single thin plate.

The driving portion 73 is disposed to close the cylindrical portion 712 defining the smaller one of the two openings of the frame 71. As shown in FIG. 6, the driving portion 73 includes the bobbin 74, a voice coil 75, and a magnetic circuit portion 76.

The bobbin 74 has a cylindrical shape, is connected to a back surface of the circular end portion 723 at the outer edge of the inner circumferential portion 721 of the diaphragm 72, and extend from the diaphragm 72 into the second space 5. The voice coil 75 is wound around the bobbin 74. The bobbin 74 corresponds to a core portion.

The magnetic circuit portion 76 is configured to apply a magnetic field to the voice coil 75. The magnetic circuit portion 76 includes a circular plate magnet 761 having one surface and the other surface, a top plate 762 connected to the one surface of the magnet 761, and a yoke 763 connected to the other surface of the magnet 761. The magnetic circuit portion 76 is formed such that the magnet 761 and the top plate 762 are disposed on a bottom portion of the yoke 763. There is a gap between a cylindrical portion of the yoke 763 and the magnet 761, and between the cylindrical portion of the yoke 763 and the top plate 762. The bobbin 74 and the voice coil 75 are inserted into the gap. An entire circumference of the yoke 763 is fitted into the cylindrical portion 712 through an inlet of the opening of the cylindrical portion 71. The yoke 763 is adhered to the cylindrical portion 712 so that the magnetic circuit portion 76 is integrally formed with the frame 71.

With this configuration, a magnetic field generated between a side surface of the top plate 762 and a side surface of the cylindrical portion of the yoke 763 is applied to the voice coil 75 wound around the bobbin 74. Therefore, when the voice coil 75 to which the magnetic field is applied is energized, the bobbin 74 is displaced in the axial direction while the bobbin 74 is fit in the cylindrical portion of the yoke 763. As a result, the diaphragm 72 vibrates and a sound is generated.

Further, the sound generating body 7 includes the lead pin 78 electrically connected to the voice coil 75. Although not shown, the lead pin 78 is electrically connected to the voice coil 75 by soldering or the like, and is drawn out from the voice coil 75 in the radial direction. In the present embodiment, the lead pin 78 is integrally formed with the frame 71 by integral molding to extend outward from the frame 71 and arranged to be in contact with the terminal 9. Then, as shown in FIG. 9, the lead pin 78 is press-fitted into a connecting groove defined in the terminal 9, so that the voice coil 75 can be electrically connected to an external member of the sound generator.

As described above, the sound generator of the present embodiment is configured. The sound generator configured as described above is disposed outside of the vehicle compartment. More specifically, the sound generator is disposed in a front bumper of the vehicle such that the emission hole 61 is disposed in a front portion of the vehicle. Then, when the voice coil 75 is energized based on sound source signals from the external member of the sound generator, the diaphragm 72 vibrates in the vibrating direction shown in FIGS. 2 and 7 and the sound generating body 7 emits sound. This sound passes through the first space 4, the sound holes 25, the sound emission space 6, and the like and exits through the emission hole 61. As a result, a vehicle such as an electric vehicle generating a quiet running noise can generate an alarming sound by the sound generator, so that it is possible to alert people around the vehicle and the like of a presence of the vehicle.

In addition, an airtightness inspection is performed as one of the manufacturing processes of the sound generator. During this airtightness inspection, a pressure difference is generated between the first space 4 and the second space 5. Specifically, the second space 5 is pressurized by sending air into the second space 5 through the emission hole 61 and the ventilation hole 241, so that the pressure of the second space 5 becomes higher than the pressure of the first space 4. As a result, as shown in FIGS. 10 and 11, the inner circumferential portion 721 and the outer circumferential portion 722 of the diaphragm 72 are displaced toward the first space 4 based on a displacement of the spring portion 724. As a result, the diaphragm 72 inflates toward the first space 4.

At this time, the deformed diaphragm 72 comes into contact with the stopper 261, which limits the deformation of the diaphragm 72. That is, the stopper 261 arranged inside the housing 1 is configured to suppress inversion and deformation of the diaphragm 72 in place of a jig that holds the diaphragm 72. Therefore, the airtightness inspection can be performed without using the jig for holding the diaphragm 72. Further, when the diaphragm 72 comes into contact with the stopper 261, the circular end portion 723 comes into contact with the cylindrical portion 261*a* and the outer circumferential portion 722 comes into contact with the tilted portions 261*b*. However, the inner circumferential portion 721 having a low strength is located inside of the cylindrical portion 261*a* does not come into contact with the stopper 261. Therefore, the diaphragm 72 can be prevented from being damaged.

Since the sound generator having such structure includes the protection wall 22 covering the sound holes 25, the sound emits through the sound emission space 6 defined by the protection wall 22, the erected wall 23, and the partition wall 24 and exits through the emission hole 61. That is, the sound generated by the sound generating body 7 is output in one direction. Therefore, it is possible to prevent the sound from being emitted in unnecessary direction and prevent unnecessary sound from propagating through the vehicle compartment.

Further, the protection wall 22 is disposed to cover the sound holes 25 at a front portion of the sound generator, that is, the protection wall covers the sound holes 25 in the vibrating direction of the diaphragm 72. Therefore, it is not necessary to secure a space for a sound passage in a mounting space of the sound generator at a position adjacent to the protection wall 22. That is, the vehicle components can be mounted in a vicinity of the protection wall 22 and the sound generator can be arranged in a narrow space in the vehicle. Therefore, it is possible to position the vehicle components close to a front of the sound generator.

Further, in the sound generator of the present embodiment, the housing 1 can be formed by molding. For example, the housing 1 can be mold by resin molding using a lower mold for molding the protection wall 22 and an outer wall surface of the erected wall 23 of the housing 1, an upper molding for molding inner wall surfaces of the base tubular portion 21 and the partition wall 24, and a slid mold for molding the sound emission space 6. Therefore, it is necessary to cover one end portion of the base tubular portion 21 with the case 3 but the other end portion of the base tubular portion 21 is covered with the protection wall 22. Thus, it is not necessary to cover the other end portion of the base tubular portion 21 with another cover. Therefore, the housing 1 can be formed by two components of the base 2 and the case 3. Thus, the number of the components can be reduced and the cost for manufacturing the product can be reduced.

Second Embodiment

A second embodiment will be described below. The second embodiment is different from the first embodiment in shapes of the sound holes 25. Other portions are similar to those of the first embodiment, and thus portions different from the first embodiment will be mainly described.

Figure 12:
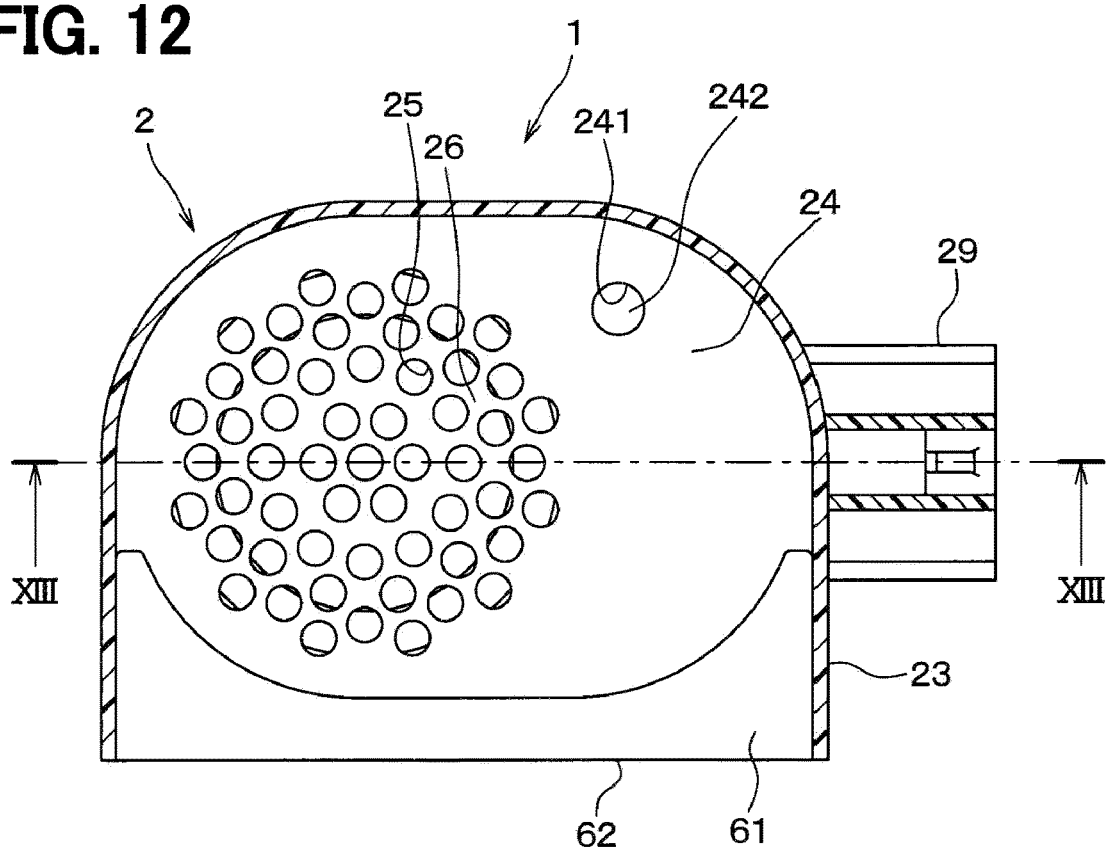
FIG. 12 is a cross-sectional view of a sound generator of a second embodiment that is taken at a position of an erected wall and viewed from a front side of the sound generator.
Figure 13:
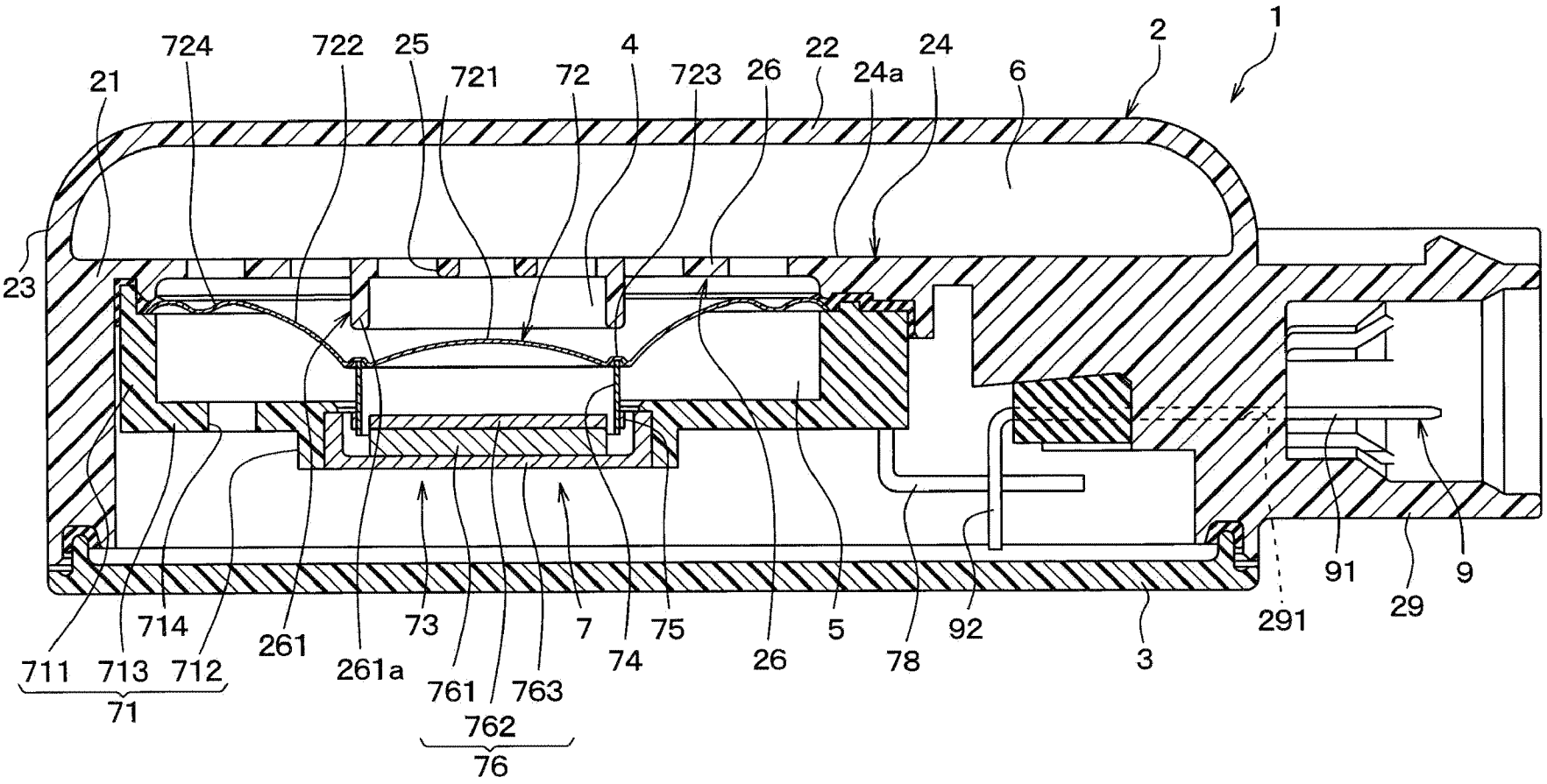
FIG. 13 is a cross-sectional view taken along a line XIII-XIII in FIG. 12.

As shown in FIGS. 12 and 13, in the present embodiment, the sound holes 25 are multiple circular through holes formed in the partition wall 24. The circular through holes serving as the sound holes 25 are radially formed from a center of the sound emission portion and rotational symmetry. A portion of the partition wall 24 in which the sound holes 25 are not defined is the beam portion 26. A portion of the partition wall 24 facing the cylindrical portion 261*a* of the stopper 261 does not define the sound holes 25 and serves as the beam portion 26. The cylindrical portion 261*a* is formed in this portion of the partition wall 24. The stopper 261 may be provided with the tilted portions 261*b* described in the first embodiment, but in the present embodiment, the tilted portions 261*b* are not provided.

In this way, the sound holes 25 can be circular through holes. It is the same for the first embodiment, but the resonance effect can be obtained and the resonance frequency can be adjusted based on the shape, dimensions, and layout of the sound holes 25. Therefore, the shape, dimensions, and layout of the sound holes 25 can be arbitrarily adjusted, and the sound holes 25 may be circular through holes as in the present embodiment.

Third Embodiment

A third embodiment will be described below. The third embodiment is different from the first embodiment in shapes of the sound holes 25. Other portions are similar to those of the first embodiment, and thus portions different from the first embodiment will be mainly described.

Figure 14:
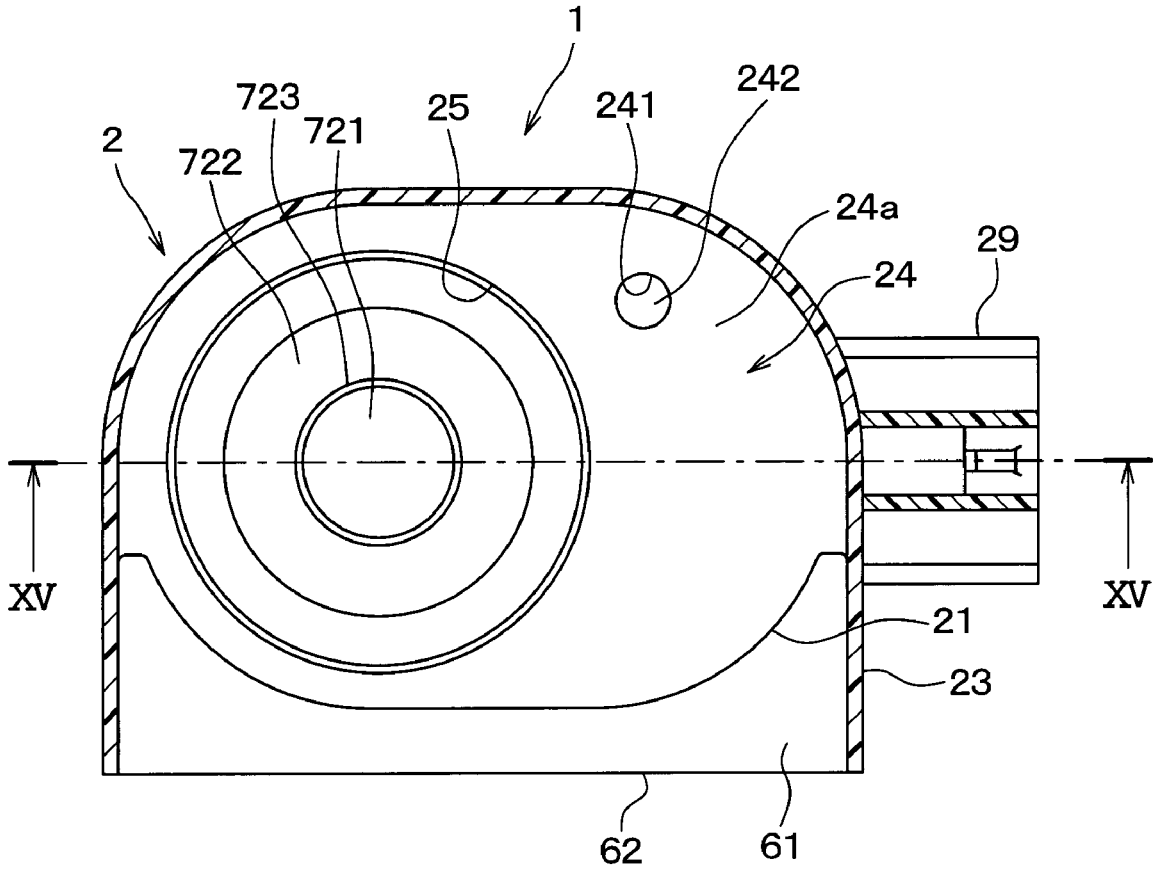
FIG. 14 is a cross-sectional view of a sound generator of a third embodiment taken at a position of an erected wall and viewed from a front side of the sound generator.
Figure 15:
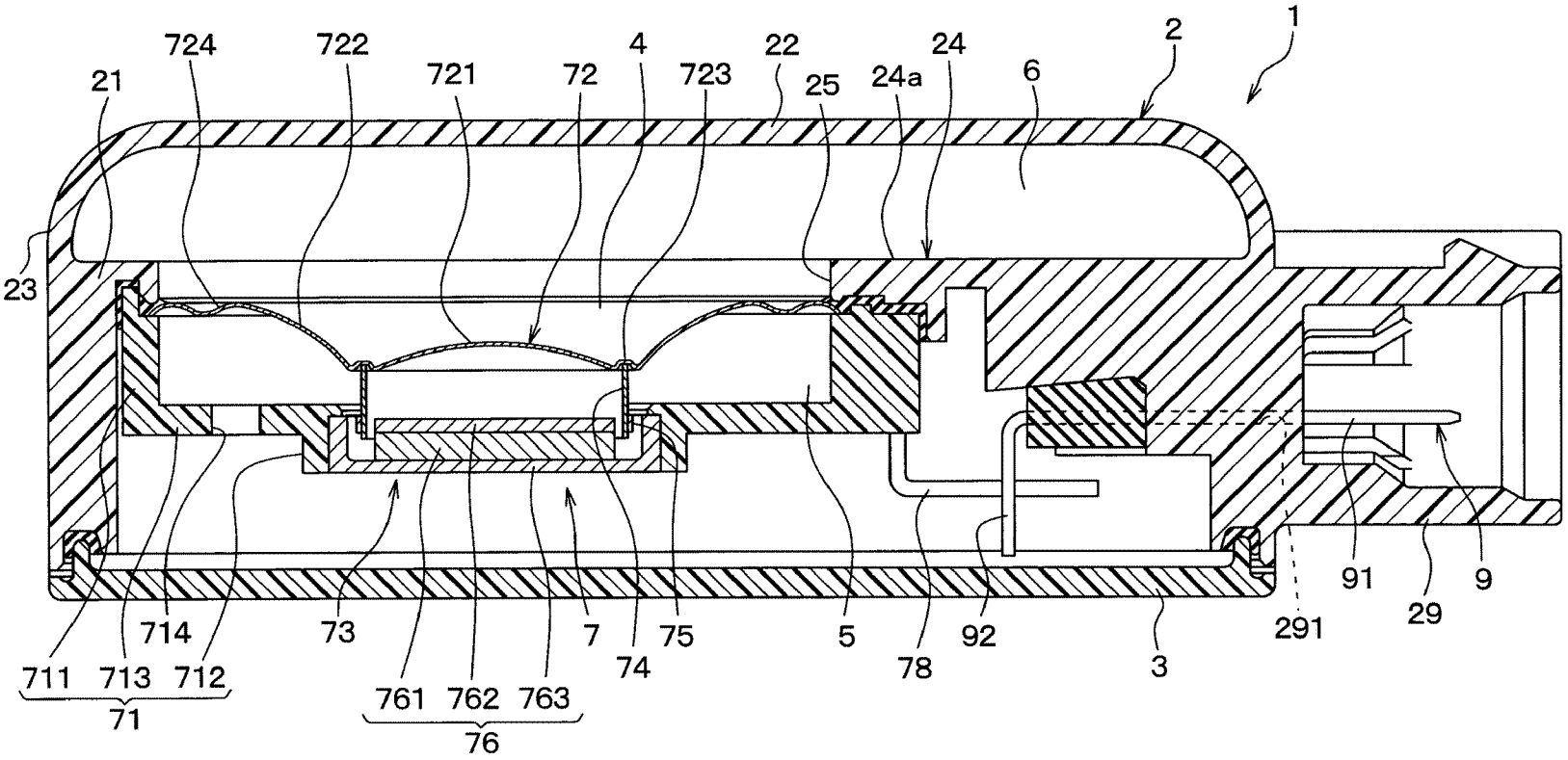
FIG. 15 is a cross-sectional view taken along a line XV-XV in FIG. 14.

As shown in FIGS. 14 and 15, in the present embodiment, a portion of the partition wall 24 corresponding to the sound emission portion opens into a circular shape to define the sound hole 25. In this way, the sound emitting hole 25 may be formed corresponding to the sound emission portion.

Figure 16:
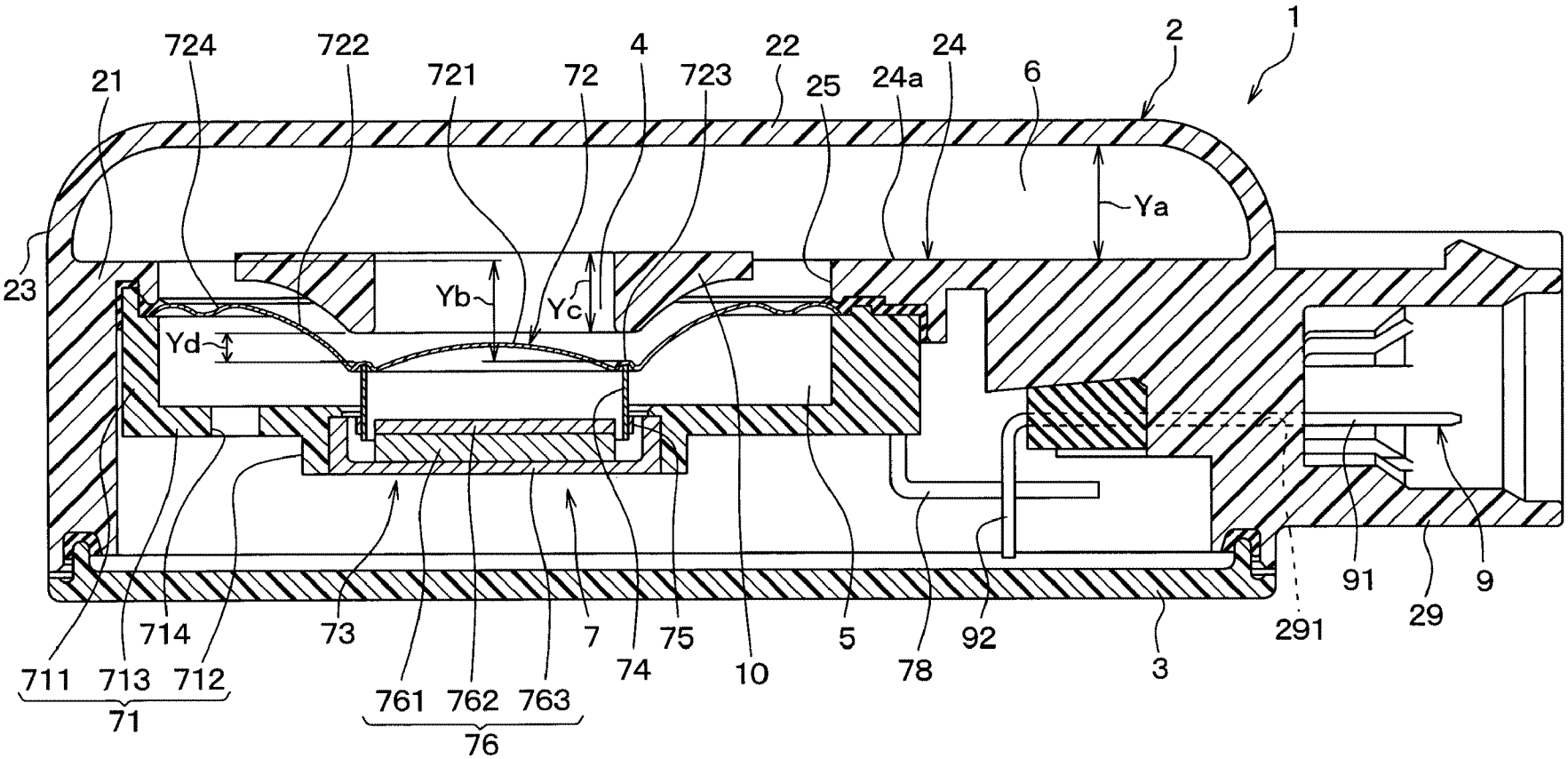
FIG. 16 is a cross-sectional view showing a state when an airtightness test is performed for the sound generator in FIG. 14 with a jig.

Further, in this structure, the stopper 261 is not provided. Therefore, when performing an airtightness inspection, as shown in FIG. 16, a jig 10 that has a tip portion having the same shape as the stopper 261 is used. In this case, the following equation is satisfied between a dimension Ya between the protection wall 22 and the one surface 24*a* of the partition wall 24, a distance Yb between the one surface 24*a* and the circular end portion 723 of the diaphragm 72, and a thickness Yc of the jig 10.

$$Ya \geq Yc \geq Yb \quad \text{(Equation 1)}$$

First, in the airtightness inspection, it is necessary to insert the jig 10 into the sound hole 25 through the emission hole 61. Therefore, it is necessary that the thickness Yc be equal to or less than the dimension Ya. Further, results of the airtightness inspection can be stabilized if the diaphragm 72 and the jig 10 are in contact with each other or a slight gap is defined therebetween. Thus, the thickness Yc of the jig 10 is set to be larger than the distance Yb. Therefore, it is possible to stabilize airtightness inspection with the jig 10 and reduce the test time by satisfying at least the equation Ya Yb.

In this way, the stopper 261 may not be provided while the sound emission portion of the partition opens to define the sound hole 25. Even in that case, the airtightness inspection can be performed with the jig 10.

When a gap Yd is provided between the diaphragm 72 and the jig 10 during the airtightness inspection, the thickness Yc of the jig 10 can be reduced, so that the thickness of the product can be reduced and Ya<Yb can be satisfied. However, it is preferable that the gap Yd have a value similar to that of a gap Ye between the stopper 261 and the diaphragm 72 at most.

Fourth Embodiment

A fourth embodiment will be described. In this embodiment, the shape of the base 2 is changed from the first and second embodiments and other portions are similar to those of the first and second embodiments. Thus, different portions from the first and second embodiments will be described. Here, a case where the shape of the base 2 in the first embodiment is changed will be described as an example. However, it can also be applied to the structure of the second embodiment.

Figure 17:
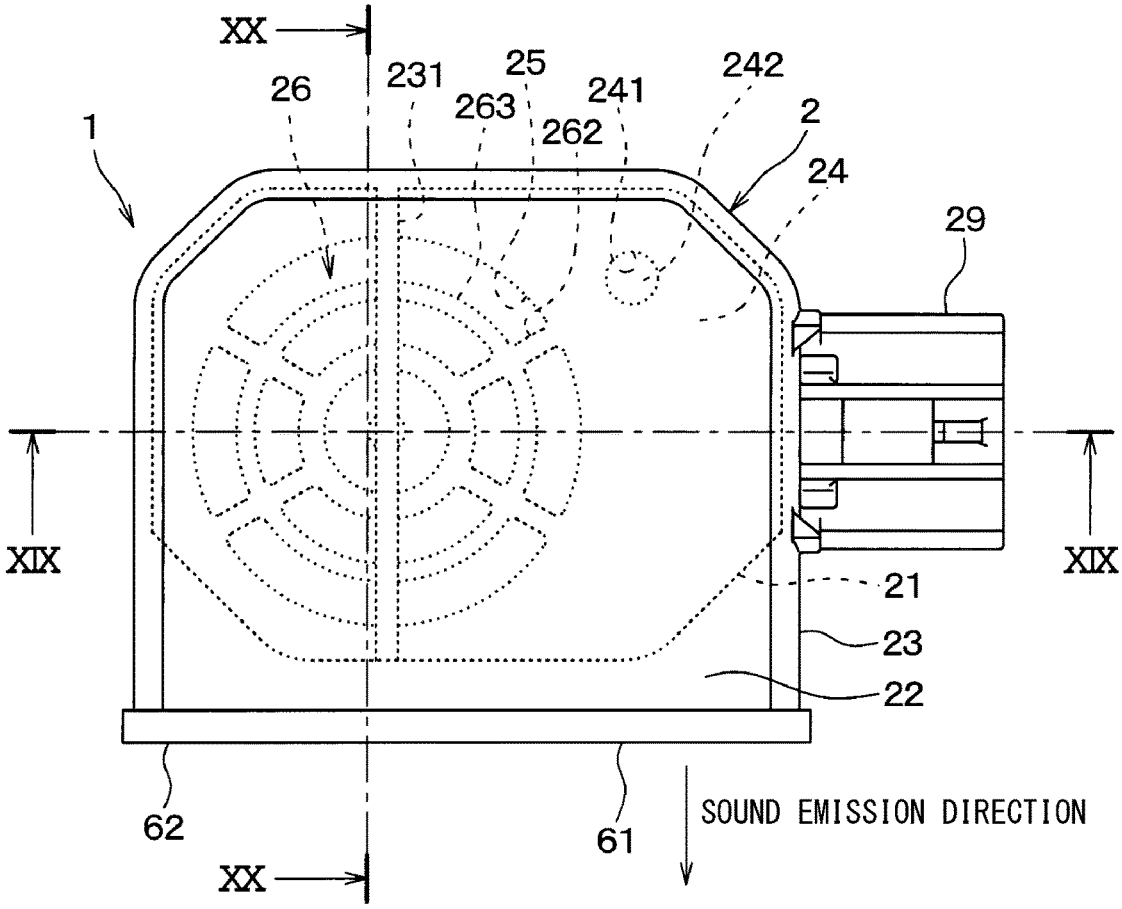
FIG. 17 is a front view of a sound generator of a fourth embodiment.
Figure 18:
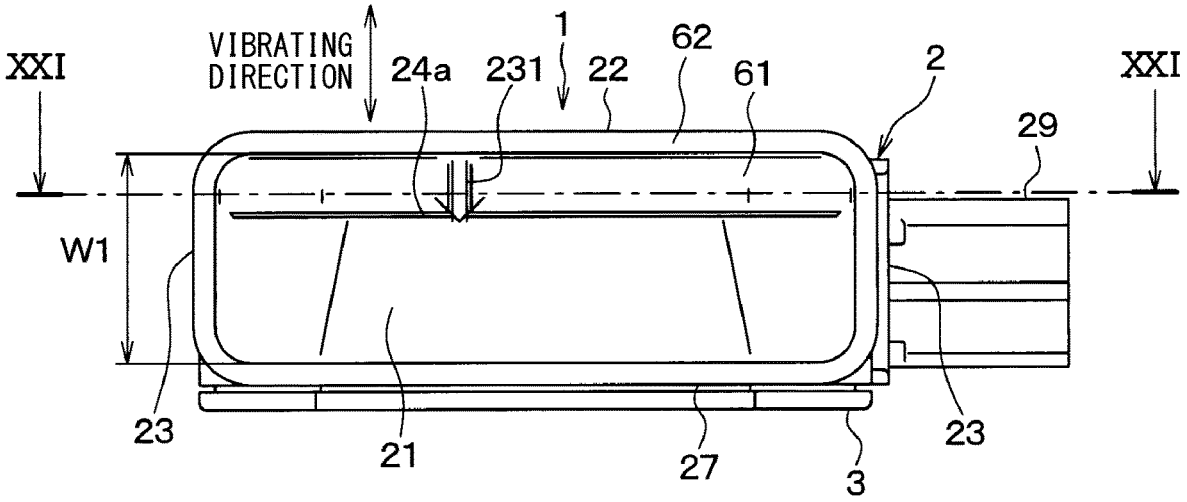
FIG. 18 is a bottom view of the sound generator shown in FIG. 17.
Figure 19:
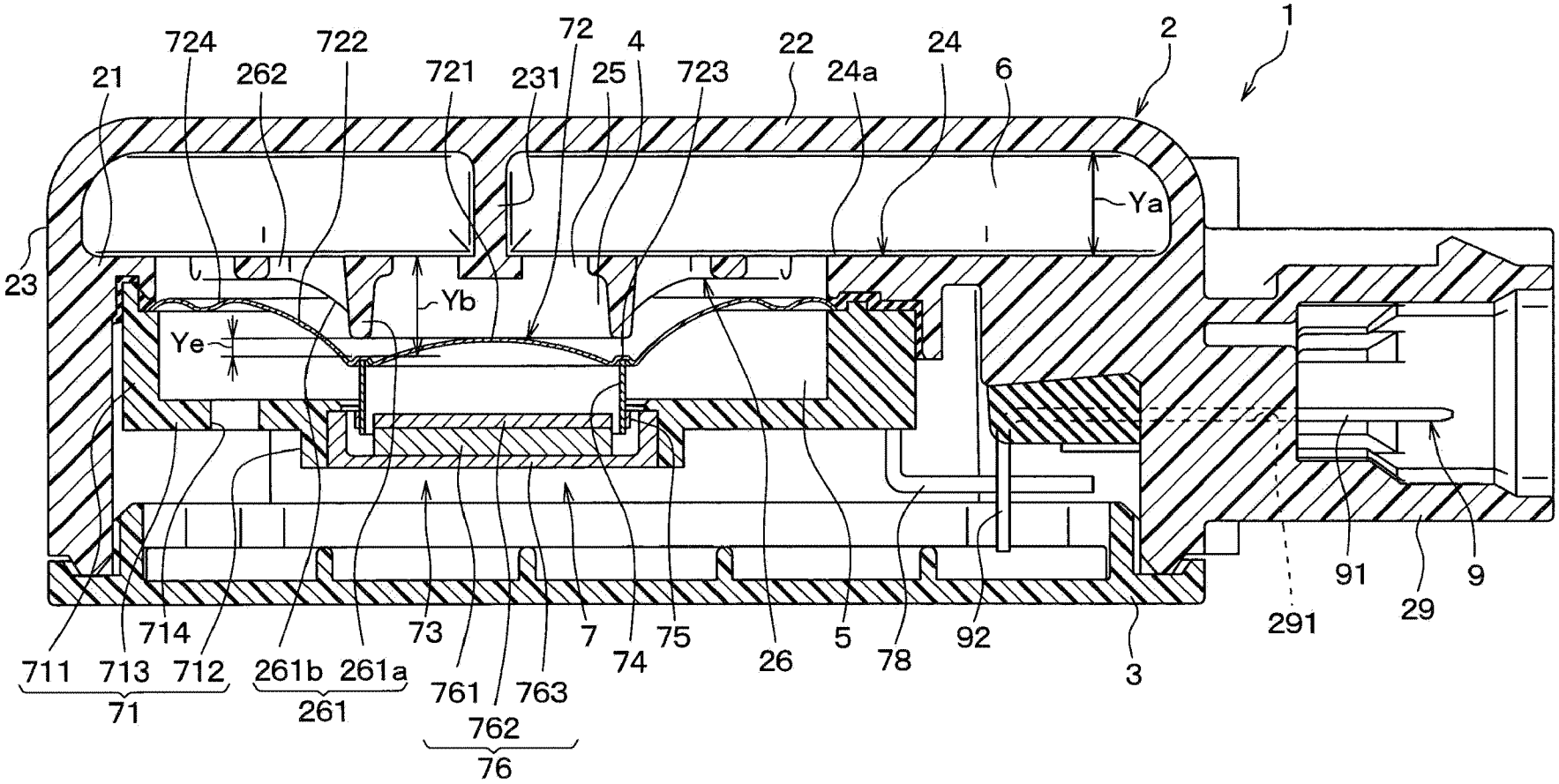
FIG. 19 is a cross-sectional view taken along a line XIX-XIX in FIG. 17.
Figure 20:
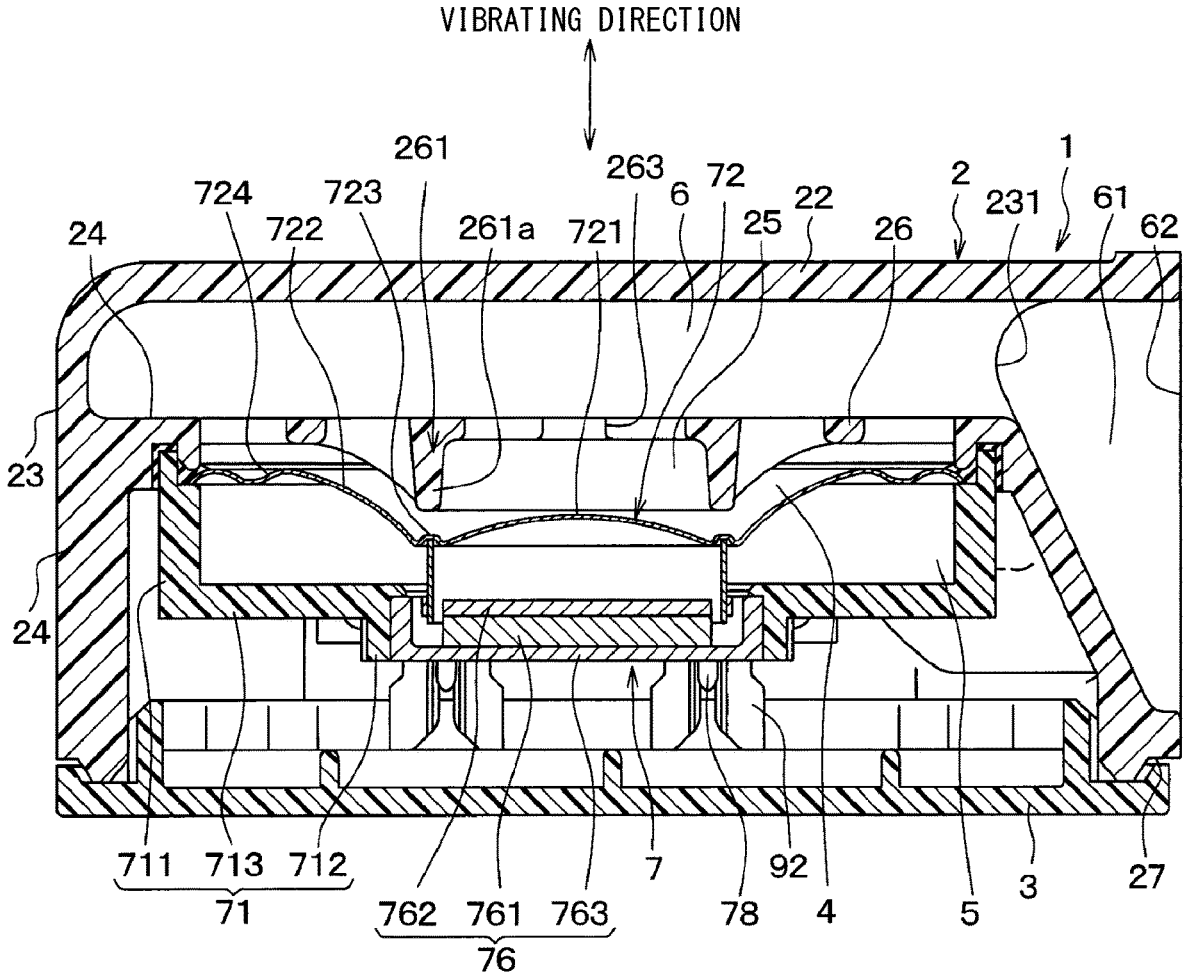
FIG. 20 is a cross-sectional view taken along a line XX-XX in FIG. 17.
Figure 21:
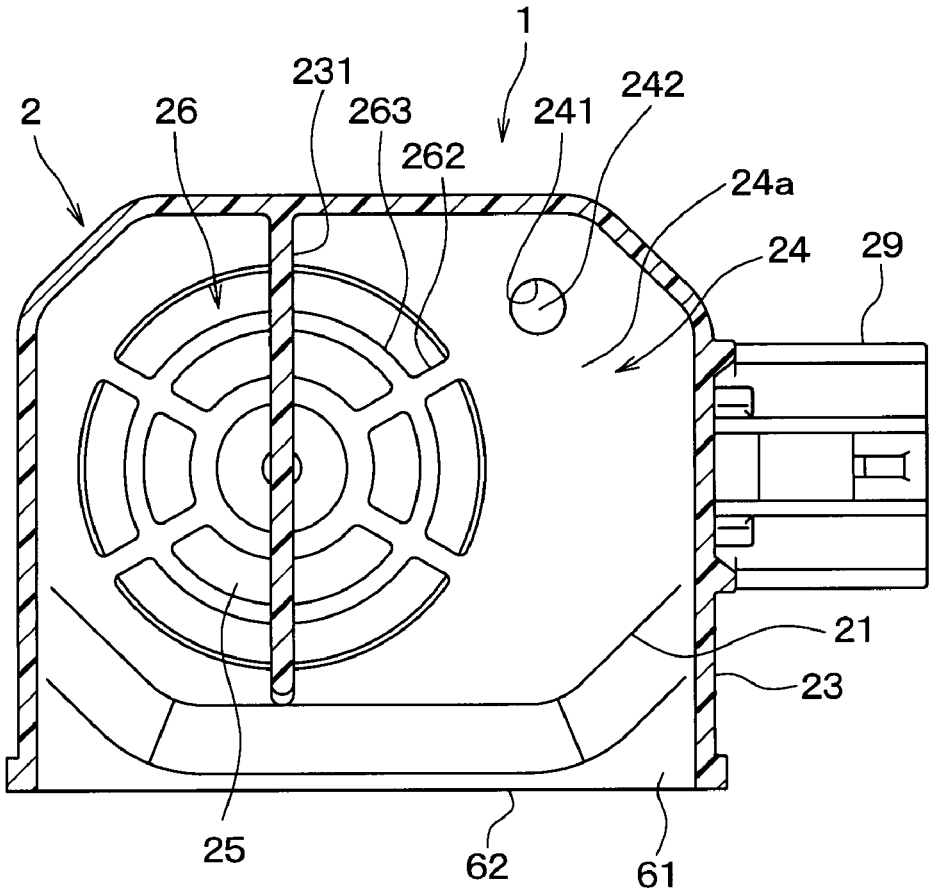
FIG. 21 is a cross-sectional view taken along a line XXI-XXI in FIG. 18.
Figure 22:
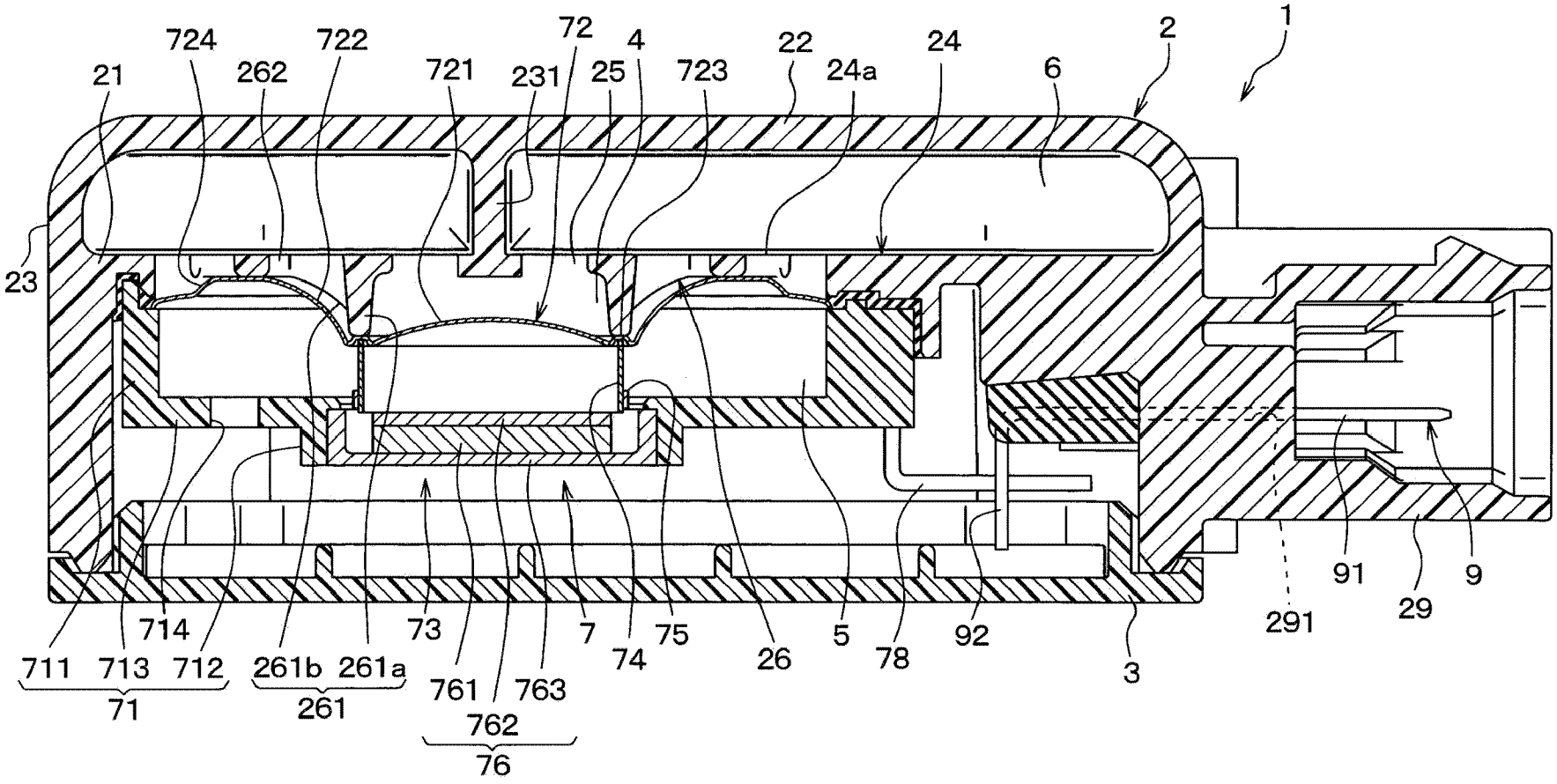
FIG. 22 is an enlarged view showing a state where a stopper and a diaphragm are in contact with each other during an airtightness inspection.

As shown in FIGS. 17 to 21, in the present embodiment, a supporter wall 231, as a part of the erected wall 23, is provided between the protection wall 22 and the one surface 24*a* of the partition wall 24. The supporter wall 231 has a height equal to a distance between the protection wall 22 and the one surface 24*a*. The supporter wall 231 extends straight from a surface of the erected wall 23 facing the emission hole 61 toward the emission hole. As shown in FIGS. 17 and 21, the supporter wall 231 extends to an end portion of the one surface 24*a* closest to the emission hole 61. By providing the supporter wall 231, the protection wall 22 and the one surface 24*a* of the partition wall 24 including the beam portion 26 are connected to each other. As a result, the distance between the one surface 24*a* and the protection wall 22 can be stabilized at a predetermined distance and the beam portion 26 can be supported by the partition wall 24 and the protection wall 22.

As a result, the strength of the protection wall 22 and the strength of the stopper 261 that comes into contact with the diaphragm 72 can be increased and positions of the protection wall 22 and the stopper 261 can be stabilized. As a result, displacement amount of the diaphragm 72 can be stabilized.

Further, the supporter wall 231 is formed to cross at least a part of the emission hole 61. Therefore, when a far side portion of the emission hole 61 is viewed in an oblique direction through the emission hole 61, the supporter wall 231 can hide a wall surface of the beam portion 26 constituting the sound holes 25 on the far side of the emission hole 61. This makes it difficult to recognize the sound holes 25 through the emission hole 61.

Further, since the supporter wall 231 is formed to partition the sound emission space 6 into two rooms, the resonance frequency in the two partitioned rooms can be adjusted according to a partition way by the supporter wall 231, whereby an acoustic effect can be obtained.

In this embodiment, the supporter wall 231 is formed to cross the entire sound hole 25. However, it is only required that the supporter wall 231 crosses at least a part of the emission hole 61 for obtaining any one of advantages of improving the strength of the stopper 261, stabilizing the deforming amount of the diaphragm 72, shielding the far side portion of the sound holes 25, and obtaining an acoustic effect. However, it is preferable that the supporter wall 231 be formed to cross a portion of the circular beam portion 263 forming the stopper 261 so that the stopper 261 can be supported by the supporter wall 231 on both sides.

Further, since the supporter wall 231 extends linearly toward the emission hole 61, the slide mold to manufacture the base 2 can be removed when the base 2 is manufactured. Therefore, the base 2 can be easily molded. When the base 2 is manufactured by molding, the position of the beam portion 26 may change due to manufacturing errors. However, since the supporter wall 231 is provided, the occurrence of the manufacturing errors can be also reduced. Therefore, molding dimensions of the beam portion 26 including the stopper 261 can be stabilized.

Further, in the present embodiment, when viewed from the vibration direction of the diaphragm 72, the shape of the base tubular portion 21 is not an oval but an octagon in which four corners of a rectangular are tilted. The erected wall 23 also has a shape along the outer shape of the base tubular portion 21. That is, when the base tubular portion 21 is partitioned along a straight line passing through a center line of the octagonal shape (i.e., the XIX-XIX line in FIG. 17), the erected wall 23 is formed along one of the partitioned sections. Further, in the other of the partitioned sections, the erected wall 23 extends from both ends in the longitudinal direction of the base tubular portion 21 along the opposing short sides of the octagon, in other words, in the sound emission direction.

As described above, the base tubular portion 21 may not have an oval shape such that corners of the sound generator opposite to the emission hole 61 have circular arc shapes. The corners of the base tubular portion 21 may be chamfered and tilted. In this way, if the corners of the base tubular portion 21 are tilted, the shape of the sound emission space 6 changes, so that the sound effect can be changed as compared with the case where the base tubular portion 21 has an oval shape.

The acoustic effect based on the shape of the sound emission space 6 also changes depending on an angle of the tilted corners of the base tubular portion 21. That is, the acoustic effect changes depending on the angle formed between each of the tilted corners and the long side of the base tubular portion 21. Therefore, the angles of the tilted corners of the base tubular portion 21 may be adjusted according to required acoustic effect.

According to one aspect of the present disclosure, the protection wall and the erected wall protrude from the base tubular portion in a direction intersecting the axial direction and the facing wall 27 is provided to face the protruding portion of the protection wall. The emission hole is defined and surrounded by the protection wall, the erected wall, and the facing wall. In such a configuration, it is preferable that the length of a portion of the erected wall defining the emission hole be shorter than that of a portion of the protection wall defining the emission hole such that the emission hole have a rectangular shape having a portion defined by the erected wall in the widthwise direction and a portion defined by the protection wall in the longitudinal direction. As a result, the vibrating direction can be the widthwise direction and a thickness of the product can be reduced. Further, an opening area required for producing an acoustic pressure can be secured while the emission hole has a rectangular shape. Further, a distal end surface of the protection wall, a distal end surface of the erected wall, and a distal end surface of the facing wall that define the emission hole are aligned with each other and extend on the common imaginary plane and the common imaginary plane defined by the distal end surfaces serves as the emission surface 62. Then, the normal direction of the emission surface can be a plane parallel to the vibrating direction of the diaphragm.

The sound emission portion of the partition wall define multiple through holes serving as the emission holes and a portion of the sound emission portion of the partition wall other than the emission holes configures the beam portion 26.

In this way, the beam portion can be provided in the area other than the emission holes in the sound emission portion. As a result, it is possible to prevent water and chippings from reaching the sound generating body during the vehicle traveling and to prevent damage to the sound generating body which is caused by contact with water or stones.

The beam portion includes the stopper 261 at a portion facing the diaphragm. The stopper 261 is configured to restrict the diaphragm from moving in the vibrating direction.

This makes it possible to reduce damage due to excessive deformation of the diaphragm during the airtightness inspection. The diaphragm includes the inner circumferential portion 721 and the outer circumferential portion 722. The inner circumferential portion protrudes toward the first space and the outer circumferential portion 722 extends from an outer edge of the inner circumferential portion toward the first space. The inner circumferential portion and the outer circumferential portion define a boundary portion therebetween. The stopper has a cylindrical portion 261*a* having a diameter same as that of the boundary portion and protruding from the beam portion toward the diaphragm. In this case, the boundary portion may have a circular end portion 723 that faces the cylindrical portion and is configured to move in the vibration direction the most when the diaphragm moves. By forming such a circular end portion, the cylindrical portion of the stopper can be brought into contact with a portion of the diaphragm having high strength.

The driving portion includes the tubular core portion 74 disposed on one surface of the diaphragm, the voice coil 75 wound around the core portion, and the magnetic circuit portion 76 configured to move the core portion and the voice coil and make the diaphragm vibrate by applying a magnetic field to the voice coil. One end of the core portion is fixed to the circular end portion facing the driving portion with an adhesive.

In this way, by fixing the one end of the core portion to the circular end portion facing the driving portion, the core portion and the diaphragm can be formed in an integral manner.

Further, the beam portion has radial beam portions 262 radially extending from a center of the sound emission portion and circular beam portions 263 coaxially disposed with each other. The cylindrical portion of the stopper can be provided in one of the circular beam portions.

The diaphragm includes the inner circumferential portion 732 protruding toward the first space and the outer circumferential portion having a hollow truncated cone shape extending from an outer edge of the inner circumferential portion toward the first space. The sound emission portion of the partition wall opens to define the sound hole. When a dimension between one surface 24*a* of the partition wall facing the protection wall and the protection wall is defined as Ya and a distance between the one surface of the partition wall and the circular end portion of the boundary portion between the inner circumferential portion and the outer circumferential portion of the diaphragm is defined as Yb, $Ya \geq Yb$ is satisfied.

In this way, when a portion of the partition wall corresponding to the sound emission portion opens to define the sound hole, the stopper may not be provided. Even in that case, if the relationship of $Ya \geq Yb$ is satisfied, it is possible to perform a stable airtightness inspection in a short time by using the jig 10.

When a dimension between one surface of the partition wall facing the protection wall is defined as Ya and a distance between the one surface of the partition wall and the boundary portion between the inner circumferential portion and the outer circumferential portion is defined as Yb, $Ya < Yb$ is satisfied.

When a gap Yd is defined between the diaphragm and the jig during the airtightness inspection, the thickness Yc of the jig can be reduced. Thus, $Ya < Yb$ can be satisfied and the thickness of the product can be reduced.

A sound generating body according to one aspect of the present disclosure has a connector 29 provided outside of the erected wall. The connector extends in a direction that intersects the vibrating direction of the diaphragm and that is parallel to the partition wall. With such a configuration, the thickness of the product can be reduced even if the connector is provided.

The erected wall includes a supporter wall 231 linearly extending from a wall surface of the erected wall facing the emission hole toward the emission hole. The supporter wall is disposed between the one surface 24*a* of the partition wall facing the protection wall and the protection wall such that the supporter wall 231 has a height same as the distance between the one surface of the partition facing the protection wall and the protection wall.

By forming the supporter wall in this way, it is possible to improve the strength of the protection wall and stabilize the arrangement location of the protection wall. For example, the supporter wall may be formed to cross the sound holes, or multiple supporter walls may be arranged in parallel to each other.

OTHER EMBODIMENTS

The present disclosure is not limited to the above described embodiments and may be suitably modified.

For example, in each of the above embodiments, examples of the shape and layout of the sound holes 25 has been presented. However, the shape and layout of the sound holes 25 are arbitrary selected and may be different from each of the above embodiments. Further, the shape of the diaphragm 72 and the shape of the stopper 261 may be other shapes. Even in that case, by restricting the displacement of the diaphragm 72 with the stopper 261, it is possible to suppress the inversion, deformation, and breakage of the diaphragm 72.

Further, in each of the above embodiments, the protection wall 22 and the erected wall 23 are configured as a part of the base 2, that is, those elements are configured by a single component as an example. However, this is merely an example and the protection wall 22 and the erected wall 23 may be separate members from each other and assembled to the base 2 to be integrally formed with each other.

Further, since the protection wall 22 covers the sound emission portion in which the sound generating body 7 is disposed, the sound emission direction can be limited. The sound emission direction may be two directions instead of limiting the sound emission direction to one direction. For example, by defining two openings with the protection wall 22 and the erected wall 23, the sound emission direction can be two directions. Even in that case, since the sound emission direction can be limited to two directions, the noise in the vehicle compartment can be reduced. Further, since the protection wall 22 covers the sound emission portion in which the sound generating body 7 is disposed, vehicle components can be positioned closer to a front surface of the sound generator.

Further, in the fourth embodiment, the number of the supporter walls 231 is one and the supporter wall crosses the sound hole 25. However, the number of the supporter walls 231 may be two or more and the multiple supporter walls 231 may be arranged in parallel to each other. The number and positions of the supporter walls 231 can be arbitrary selected, and the length of each of the supporter walls 231 can be also arbitrary selected. In that case, the lengths of the multiple supporter walls 231 may be the same or different from each other. As the number of supporter walls 231 increases, the effect of stabilizing the displacement amount of the diaphragm 72 increases and it becomes more difficult to recognize the sound holes 25.

Further, in the fourth embodiment, the supporter wall 231 is provided in a structure having the stopper such as the first embodiment and the second embodiment. However, the supporter wall 231 may be provided in a structure without the stopper 261 such as the third embodiment. However, in that case, the effect of stabilizing the stopper 261 cannot be obtained.

What is claimed is:

1. A sound generator configured to generate a sound by vibrating a diaphragm, the sound generator comprising:

a sound generating body including the diaphragm and a driving portion configured to vibrate the diaphragm when energized to generate the sound;

a base including;

a base tubular portion configured to house the sound generating body; and a partition wall disposed in one end portion of the base tubular portion in an axial direction of the base tubular portion and having a sound emission portion where the sound generating body is disposed, the sound emission portion of the partition wall defining a sound hole through which the sound generated by the sound generating body emits, the diaphragm and the partition wall dividing an inner space of the base tubular portion into a first space and a second space, a protection wall disposed away from the partition wall in a vibrating direction of the diaphragm with a gap to cover the sound emission portion of the partition wall;

an erected wall connecting between the protection wall and the base tubular portion, the protection wall, the erected wall, and the partition wall defining a sound emission space, wherein the sound emission space is in communication with the first space through the sound hole, the protection wall and the erected wall define an emission hole opening in at least one direction, and the sound emits into the sound emission space through the sound hole from the first space and exits through the emission hole.

2. The sound generator according to claim 1, wherein the protection wall and the erected wall have protruding portions that protrude more than the base tubular portion in a direction intersecting the axial direction, and the sound generator further comprises a facing wall facing the protruding portion of the protection wall, wherein the emission hole is surrounded by the protection wall, the erected wall, and the facing wall.

3. The sound generator according to claim 2, wherein a portion of the erected wall defining the emission hole is shorter than a portion of the protection wall defining the emission hole, so that the emission hole has an elongated shape having a widthwise direction along the erected wall and a longitudinal direction along the protection wall.

4. The sound generator according to claim 3, wherein a distal end of the protection wall, a distal end of the erected wall, and a distal end of the facing wall are aligned with each other on a common imaginary plane, and the common imaginary plane serves as an emission plane of the emission hole.

5. The sound generator according to claim 4, wherein a normal direction of the emission plane is parallel to the vibrating direction of the diaphragm.

6. The sound generator according to claim 1, wherein the sound emission portion of the partition wall defines a plurality of through holes serving as the sound hole, and the sound emission portion other than the sound hole serves as a beam portion.

7. The sound generator according to claim 6, wherein the beam portion includes a stopper on a portion of the beam portion facing the diaphragm, and the stopper is configured to restrict the diaphragm from moving in the vibrating direction.

8. The sound generator according to claim 7, wherein the diaphragm includes:

an inner circumferential portion protruding toward the first space; and an outer circumferential portion having a hollow truncated cone shape that extends from an outer edge of the inner circumferential portion toward the first space, the inner circumferential portion and the outer circumferential portion define a circular boundary therebetween, and the stopper includes a cylindrical portion having a diameter same as that of the circular boundary and protruding from the beam portion toward the diaphragm.

9. The sound generator according to claim 8, wherein the boundary of the diaphragm includes a circular end portion that faces the cylindrical portion of the stopper and that is configured to move the most in the vibrating direction when the diaphragm moves.

10. The sound generator according to claim 9, wherein the driving portion includes:

a tubular core portion disposed on one surface of the diaphragm;

a voice coil wound around the core portion; and a magnetic circuit portion configured to move the core portion and the voice coil and to vibrate the diaphragm by applying a magnetic field to the voice coil, wherein the core portion of the driving portion has one end connected to a portion of the circular end portion of the diaphragm that faces the driving portion with an adhesive.

11. The sound generator according to claim 8, wherein the beam portion includes a plurality of radial beams radially extending from a center of the sound emission portion and a plurality of circular beams coaxially disposed with each other, and the cylindrical portion is disposed in one of the plurality of circular beams.

12. The sound generator according to claim 8, wherein the partition wall has one surface facing the protection wall, Ya is defined as a dimension between the one surface of the partition wall and the protection wall, Yb is defined as a dimension between the one surface of the partition wall and the boundary between the inner circumferential portion and the outer circumferential portion of the diaphragm, and $Ya<Yb$.

13. The sound generator according to claim 1, wherein the diaphragm includes:

an inner circumferential portion protruding toward the first space; and an outer circumferential portion having a hollow truncated cone shape that extends from an outer edge of the inner circumferential portion toward the first space, the sound emission portion of the partition wall has one opening serving as the sound hole, the partition wall has one surface facing the protection wall, Ya is defined as a dimension between the one surface of the partition wall and the protection wall, Yb is defined as a dimension between the one surface of the partition wall and a boundary between the inner circumferential portion and the outer circumferential portion of the diaphragm, and Ya≥Yb.

14. The sound generator according to claim 1 further comprising a connector disposed outside of the erected wall and extending in a direction that intersects the vibrating direction of the diaphragm and that is parallel to the partition wall.

15. The sound generator according to claim 1, wherein the partition wall includes one surface facing the protection wall, the erected wall includes a supporter extending straight from a portion of the erected wall facing the emission hole toward the emission hole, the supporter is disposed between the one surface of the partition wall and the protection wall and has a height same as a distance between the one surface of the partition wall and the protection wall.

16. The sound generator according to claim 15, wherein the supporter crosses the sound hole.

17. The sound generator according to claim 15, wherein the supporter includes a plurality of supporters disposed parallel to each other, and the plurality of supporters are disposed between the one surface (24*a*) of the partition wall and the protection wall.

18. A method for manufacturing a sound generator configured to generate a sound by vibrating a diaphragm, the method comprising:

preparing a sound generator including:

a sound generating body that includes:

the diaphragm including an inner circumferential portion and an outer circumferential portion that has a hollow truncated cone shape and extends outward from an outer edge of the inner circumferential portion; and a driving portion configured to vibrate the diaphragm when energized to generate the sound;

a base that includes;

a base tubular portion configured to house the sound generating body; and a partition wall disposed in one end portion of the base tubular portion in an axial direction of the base tubular portion and having a sound emission portion where the sound generating body is disposed, the sound emission portion of the partition wall defining a sound hole through which the sound generated by the sound generating body emits, the diaphragm and the partition wall dividing an inner space of the base tubular portion into a first space and a second space;

a protection wall that is disposed away from the partition wall in a vibrating direction of the diaphragm with a gap to cover the sound emission portion of the partition wall; and an erected wall that connects between the protection wall and the base tubular portion, the protection wall, the erected wall, and the partition wall defining a sound emission space, wherein the sound emission space is in communication with the first space through the sound hole, the sound emission space defines an emission hole opening in at least one direction, the sound emits to the sound emission space through the sound hole from the first space and exits through the emission hole, the partition wall has one surface facing the protection wall, Ya is defined as a distance between the one surface and the protection wall, Yb is defined as a distance between the one surface of the partition wall and a boundary between the inner circumferential portion and the outer circumferential portion of the diaphragm, and Ya>Yb; and testing an airtightness of the sound generator by:

inserting a jig into the sound hole through the emission hole; and increasing a pressure in the second space to be higher than a pressure in the first space and to inflate the diaphragm toward the first space while the jig is set inside the sound hole.

* * * * *